US010350885B2

(12) United States Patent
Aoki et al.

(10) Patent No.: US 10,350,885 B2
(45) Date of Patent: Jul. 16, 2019

(54) LIQUID DISCHARGE DEVICE AND LIQUID DISCHARGE HEAD

(71) Applicant: CANON KABUSHIKI KAISHA, Tokyo (JP)

(72) Inventors: Takatsuna Aoki, Yokohama (JP); Shuzo Iwanaga, Kawasaki (JP); Seiichiro Karita, Saitama (JP); Kazuhiro Yamada, Yokohama (JP); Shingo Okushima, Kawasaki (JP); Zentaro Tamenaga, Sagamihara (JP); Akira Yamamoto, Yokohama (JP); Tatsurou Mori, Yokohama (JP); Noriyasu Nagai, Tokyo (JP); Akio Saito, Machida (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/597,682

(22) Filed: May 17, 2017

(65) Prior Publication Data

US 2017/0341381 A1 Nov. 30, 2017

(30) Foreign Application Priority Data

May 27, 2016 (JP) ..... 2016-106528
Apr. 25, 2017 (JP) ..... 2017-086281

(51) Int. Cl.
*B41J 29/38* (2006.01)
*B41J 2/045* (2006.01)
(Continued)

(52) U.S. Cl.
CPC ..... *B41J 2/04563* (2013.01); *B41J 2/0458* (2013.01); *B41J 2/04528* (2013.01);
(Continued)

(58) Field of Classification Search
None
See application file for complete search history.

(56) References Cited

U.S. PATENT DOCUMENTS 5,867,200 A * 2/1999 Tajima ..... B41J 2/04506 347/13
8,608,276 B2 12/2013 Oohashi et al.
(Continued)

FOREIGN PATENT DOCUMENTS

CN 102259495 A 11/2011
CN 105383178 A 3/2016
JP 2007-021944 A 2/2007

OTHER PUBLICATIONS

Office Action dated Dec. 5, 2018, in Chinese Patent Application No. 201710411581.1.

*Primary Examiner* — Matthew Luu
*Assistant Examiner* — Tracey M McMillion
(74) *Attorney, Agent, or Firm* — Venable LLP

(57) ABSTRACT

A liquid discharge device performs recording by use of a liquid discharge head including discharge ports to discharge a liquid, pressure generation elements to generate energy to be used to discharge the liquid, and pressure chambers communicating with the discharge ports. The liquid discharge device includes a control unit to control a temperature of the liquid discharge head by applying heat with heating elements arranged in divided areas of a region of the liquid discharge head where the discharge ports are arranged. When there is recording data for the discharge port in a certain one of the divided areas, the control unit causes the heating element in the divided area to generate heat, and when there is no recording data for the discharge port in the certain divided area, the control unit keeps the heating element in the certain divided area from generating heat.

29 Claims, 25 Drawing Sheets

(51) Int. Cl.
*B41J 2/14* (2006.01)
*B41J 2/155* (2006.01)

(52) U.S. Cl.
CPC ..... *B41J 2/04551* (2013.01); *B41J 2/1404* (2013.01); *B41J 2/155* (2013.01); *B41J 2202/12* (2013.01); *B41J 2202/20* (2013.01)

(56) References Cited

U.S. PATENT DOCUMENTS

| | | | | |
|---|---|---|---|---|
| 9,662,878 | B2 | 5/2017 | Yamauchi et al. | |
| 2009/0046123 | A1* | 2/2009 | Muraoka | B41J 2/16538 347/33 |
| 2012/0162318 | A1 | 6/2012 | Muraoka et al. | |
| 2016/0052265 | A1* | 2/2016 | Yamauchi | B41J 13/0009 347/17 |
| 2017/0225458 | A1 | 8/2017 | Yamauchi et al. | |

* cited by examiner

RECORDING DIRECTION

| | | | | |
|---|---|---|---|---|
| DISENABLE | DISENABLE | ENABLE | ENABLE | #1 |
| DISENABLE | DISENABLE | ENABLE | ENABLE | #2 |
| DISENABLE | DISENABLE | ENABLE | ENABLE | #3 |
| DISENABLE | DISENABLE | ENABLE | ENABLE | #4 |
| DISENABLE | DISENABLE | ENABLE | ENABLE | #5 |
| DISENABLE | DISENABLE | ENABLE | ENABLE | #6 |
| DISENABLE | DISENABLE | ENABLE | ENABLE | #7 |
| DISENABLE | DISENABLE | ENABLE | ENABLE | #8 |
| DISENABLE | DISENABLE | ENABLE | ENABLE | #9 |
| DISENABLE | DISENABLE | ENABLE | ENABLE | #10 |
| DISENABLE | DISENABLE | ENABLE | ENABLE | #11 |
| DISENABLE | DISENABLE | ENABLE | ENABLE | #12 |
| DISENABLE | DISENABLE | ENABLE | ENABLE | #13 |

FIG.11B

LIQUID DISCHARGE DEVICE AND LIQUID DISCHARGE HEAD

This application claims the benefit of Japanese Patent Application No. 2016-106528, filed May 27, 2016, and No. 2017-086281, filed Apr. 25, 2017, which are hereby incorporated by reference herein their entirety.

BACKGROUND OF THE INVENTION

Field of the Invention

The present invention relates to a liquid discharge device and a liquid discharge head, or more specifically, to temperature control of a liquid discharge head.

Description of the Related Art

A technique described in Japanese Patent Laid-Open No. 2007-021944 has been known as an aspect of temperature control of a liquid such as an ink in a liquid discharge head like a recording head, which is used in a liquid discharge device as typified by an inkjet recording apparatus. Japanese Patent Laid-Open No. 2007-021944 describes heating control of inks for discharge ports that perform discharge and discharge ports that do not perform discharge, which is conducted in accordance with recording data for the respective discharge ports.

However, according to the temperature control disclosed in Japanese Patent Laid-Open No. 2007-021944, a target temperature of the control is usually set higher than an environmental temperature. For this reason, the inks at the discharge ports that do not perform discharge are also heated along with the temperature control, whereby evaporation of certain ink components such as volatile components is promoted. As a consequence, the inks are likely to increase color material concentrations and viscosities, which may lead to color unevenness of an image recorded as well as deterioration in dot landing accuracy attributed to a change in ink discharge speed, and eventually to deterioration in quality of a recorded image. This problem may become noticeable particularly in a liquid discharge head of a so-called full-line type which includes numerous discharge ports arrayed.

SUMMARY OF THE INVENTION

In order to solve the above problems, the present invention is a liquid discharge device to perform recording by use of a liquid discharge head including discharge ports to discharge a liquid, pressure generation elements to generate energy to be used to discharge the liquid, and pressure chambers communicating with the discharge ports, the liquid discharge device includes: a control unit to control a temperature of the liquid discharge head by applying heat with heating elements arranged in divided areas of a region of the liquid discharge head where the discharge ports are arranged. When there is recording data for the discharge port in a certain one of the divided areas, the control unit causes the heating element in the divided area to generate heat, and when there is no recording data for the discharge port in the certain divided area, the control unit keeps the heating element in the certain divided area from generating heat.

Further features of the present invention will become apparent from the following description of exemplary embodiments with reference to the attached drawings.

BRIEF DESCRIPTION OF THE DRAWINGS

FIG. 5 is a diagram showing the relationship of FIGS. 5A and 5B;

FIG. 7 is a diagram showing the relationship of FIGS. 7A and 7B;

FIG. 10 is a diagram showing the relationship of FIGS. 10A and 10B;

FIGS. 11A and 11B are diagrams describing heating ranges relative to discharge port ranges corresponding to recording data in the temperature control shown in FIGS. 10A and 10B;

DESCRIPTION OF THE EMBODIMENTS

Embodiments of the present invention will be described below with reference to the accompanying drawings. It is to be noted that a liquid discharge head of the present invention which discharges a liquid such as an ink, and a liquid discharge device loaded with the liquid discharge head are applicable to apparatuses such as a printer, a copier, a facsimile machine provided with a communication system, an apparatus such as a word processor provided with a printer unit, and moreover, industrial recording apparatuses obtained by combining various processing devices. For example, the liquid discharge head and the liquid discharge device can also be used for applications including biochip fabrication, electronic circuit printing, semiconductor substrate fabrication, and so forth. Moreover, the embodiments described below represent appropriate specific examples of the present invention and are therefore subjected to various limitations that are deemed to be preferable from the technical perspectives. It is to be noted, however, that the present invention is not limited only to the embodiments described in this specification or to other specific methods, but should encompass other embodiments within the scope of the invention.

Figure 1:
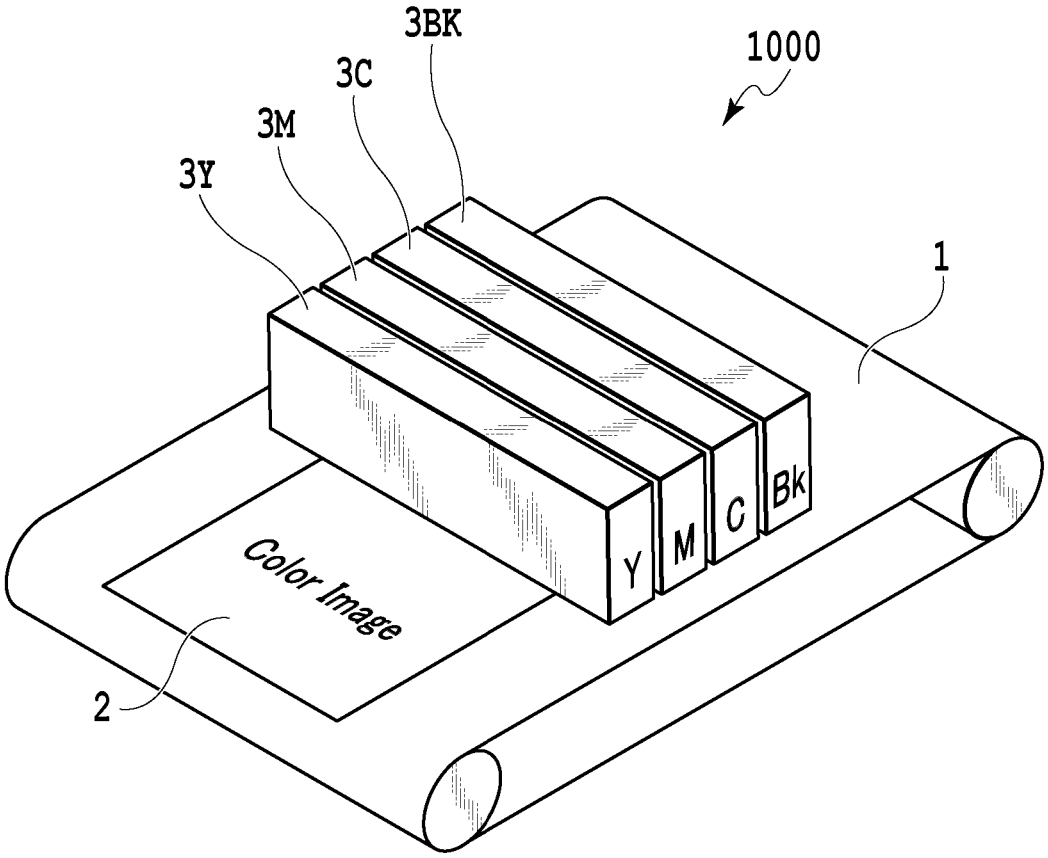
FIG. 1 is a perspective view showing a liquid discharge device according to a certain embodiment of the present invention.

FIG. 1 is a perspective view showing a liquid discharge device according to a certain embodiment of the present invention. A recording apparatus 1000 according to the certain embodiment of the present invention includes: a conveyance unit 1 which conveys a record medium 2; and liquid discharge heads 3Bk, 3C, 3M, and 3Y (each of the heads or the whole four heads may be hereinafter also indicated with a reference numeral 3 as appropriate) corresponding to black (Bk), cyan (C), magenta (M), and yellow (Y) inks, respectively, which are arranged in a direction substantially perpendicular to a conveyance direction of the record medium 2. Each liquid discharge head 3 is a so-called line-type liquid discharge head having a length corresponding to a width of the record medium 2. The recording apparatus 1000 discharges the inks from the respective liquid discharge heads 3, thereby recording images and the like on the record media 2 that are conveyed continuously or intermittently by the conveyance unit 1. Here, the record media 2 are not limited only to cut paper but may instead be record media in the form of continuous rolled paper. Although the liquid discharge heads in the line-type mode will be described below, the present invention is not limited to this mode but is also applicable to liquid discharge heads of a so-called serial type, which perform recording while moving relative to a record medium.

Figure 2:
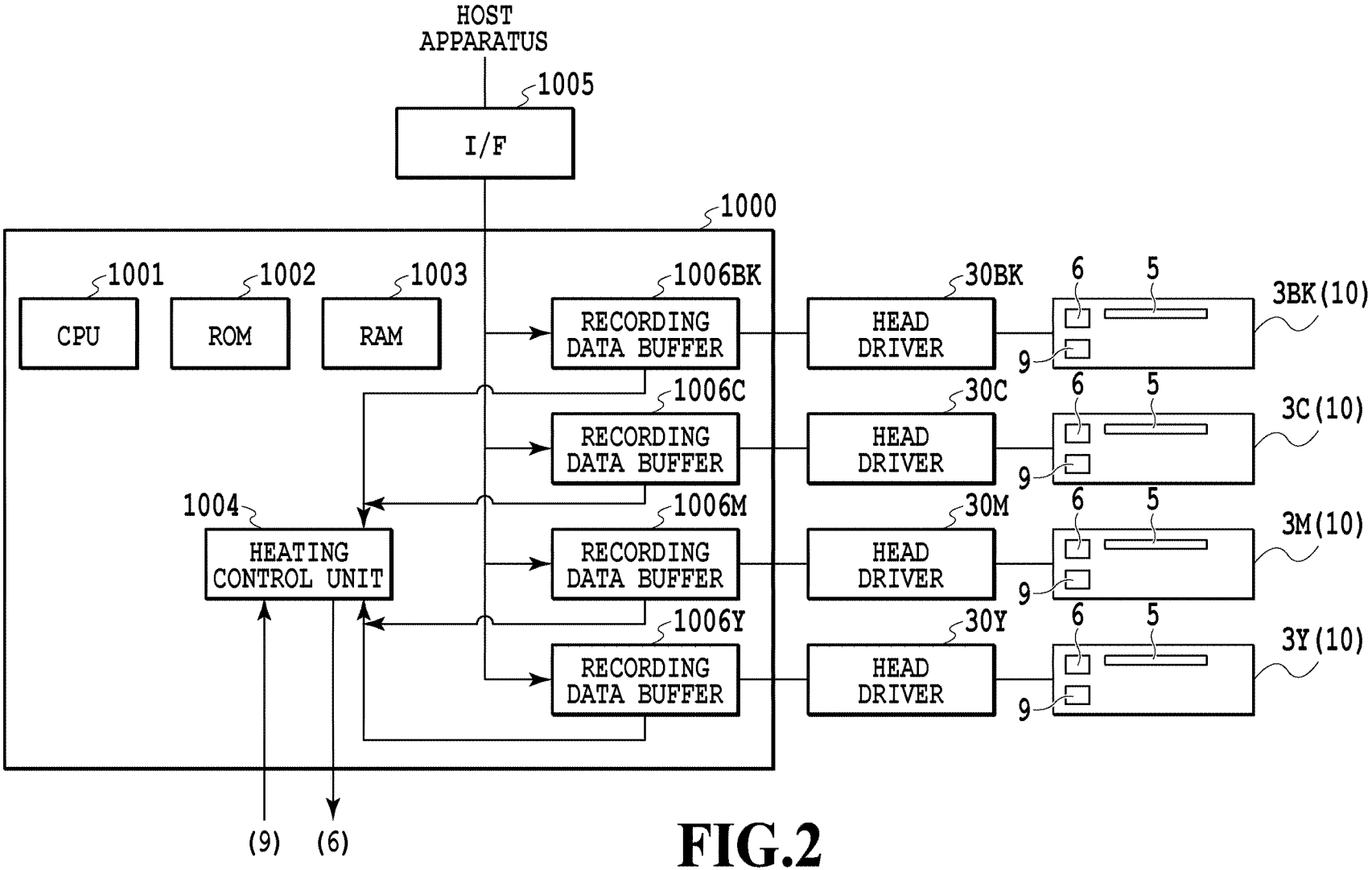
FIG. 2 is a block diagram showing a control configuration for recording heads shown in FIG. 1.

FIG. 2 is a block diagram showing a control configuration for the recording heads shown in FIG. 1, which specifically shows a configuration for temperature control of the liquid discharge heads 3 to be described later with reference to FIGS. 5A and 5B and the like. As shown in FIG. 2, the recording apparatus 1000 receives recording commands and recording data, which are sent from a host apparatus such as a PC, through an I/F 1005 and temporarily stores the recording commands and the recording data in recording data buffers 1006Bk, 1006C, 1006M, and 1006Y provided for the respective ink colors. Then, based on the recording commands and the recording data stored in the buffers, the recording apparatus 1000 performs ink discharge by driving the liquid discharge heads 3Bk, 3C, 3M, and 3Y through head drivers 30Bk, 30C, 30M, and 30Y, respectively. A CPU 1001 executes the drive of the liquid discharge heads described above and the temperature control of the liquid discharge heads shown below in accordance with given programs. A ROM 1002 stores the programs to be executed, and the like. Meanwhile, a RAM 1003 is used as a work area at the time of execution of the aforementioned processing.

Each liquid discharge head 3 is formed by arranging multiple boards 10 to be described later with reference to FIGS. 3A and 3B. Each board 10 is provided with heating elements 5, drivers 6 to drive the elements, and temperature detection elements 9, all of which are used for the temperature control of the liquid discharge head. Note that FIG. 2 schematically illustrates these elements and does not demonstrate actual layouts and sizes thereof. In the meantime, the liquid discharge head may include a single board 10 instead of the multiple boards 10. As described later with reference to FIGS. 5A and 5B and the like, a heating control unit 1004 in the recording apparatus 1000 drives and controls the heating elements 5 of each liquid discharge head through the drivers 6. Moreover, the heating control unit 1004 performs the temperature control with reference to temperature information from the temperature detection elements 9. The heating control unit 1004 functions in conjunction with execution of the programs developed in the RAM 1003 by the CPU 1001.

A description will be given below of several specific embodiments concerning the temperature control of the liquid discharge heads in the liquid discharge device provided with the above-mentioned basic configuration.

(First Embodiment)

Figure 3A:
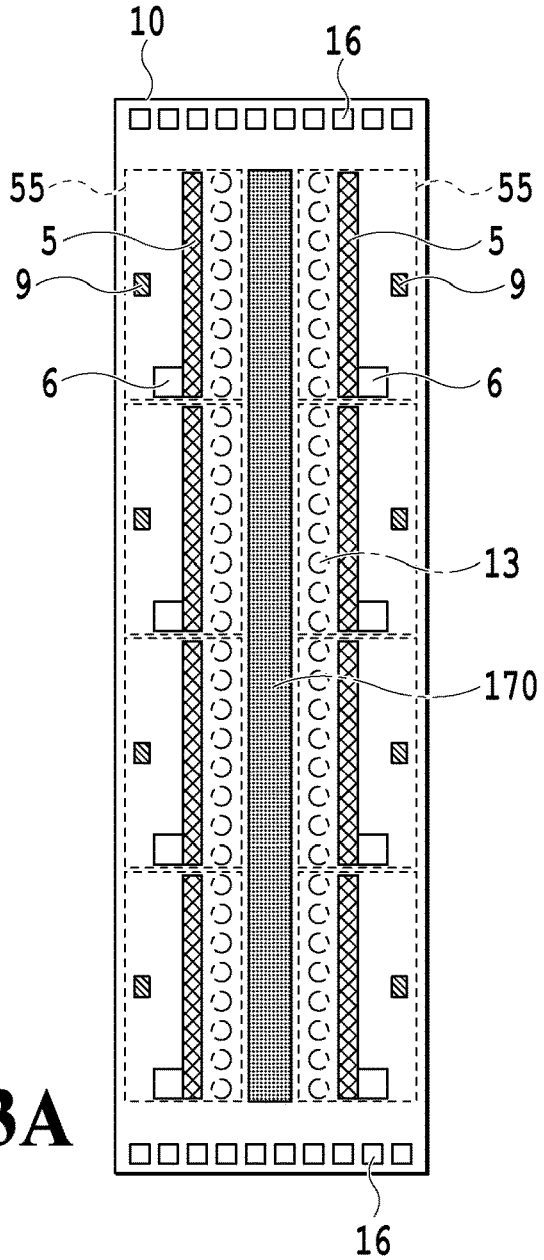
FIGS. 3A and 3B are views showing a recording element board constituting a liquid discharge head according to a first embodiment of the present invention.
Figure 3B:
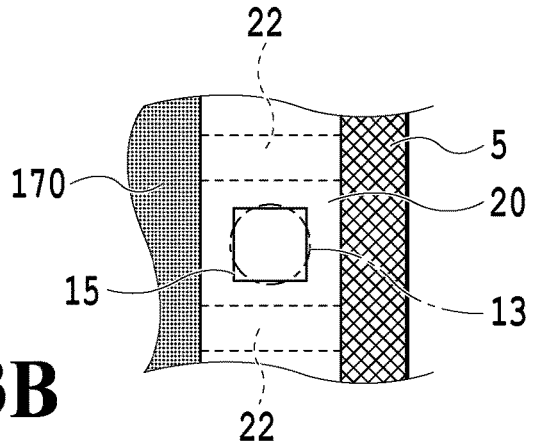

FIGS. 3A and 3B are views showing a recording element board 10 constituting a liquid discharge head according to a first embodiment of the present invention, in which FIG. 3B is a partially enlarged view of the board shown in FIG. 3A. Each liquid discharge head 3 shown in FIG. 1 is formed by arranging multiple recording element boards 10 shown in FIG. 3A in such a way that discharge ports 13 are arranged in the direction substantially perpendicular to the conveyance direction of the record medium. In other words, FIG. 3A illustrates one of the multiple recording element boards.

As shown in FIG. 3B, a flow channel formation member (not illustrated) provided with the discharge ports 13 and partition walls 22 is formed on the recording element board 10 of this embodiment. Pressure chambers 20 corresponding to respective heaters 15, and the discharge ports 13 communicating with the pressure chambers 20 and the heaters 15 are formed on the board 10. In other words, a flow channel structure in the vicinity of each discharge port of this embodiment is formed to dispose each pressure chamber 20 in such a way as to communicate with an ink supply port 170 provided on one side of the array of heaters 15. Moreover, the pressure chamber 20 is formed into such a shape being surrounded by the square U-shaped partition wall module including the partition walls 22 on two sides (though the partition wall on the right side is not illustrated in FIG. 3B), so that only one side adjacent to the ink supply port 170 is opened.

In the recording element board 10 shown in FIG. 3A, pads 16 establish connection with electric signals to the head driver 30 of the recording apparatus 1000 described with reference to FIG. 2. Thus, the recording data associated with the recording, discharge port selection data signals, electric power supply, and the like are supplied to the recording element board 10. The ink supply port 170 for supplying an ink to the respective pressure chambers 20 (not shown in FIG. 3A) is provided at a central part of the recording element board 10. The heaters 15 (not shown in FIG. 3A) are disposed at the respective pressure chambers 20. By driving and heating the heaters 15 in accordance with the recording data, bubbles are generated in the ink and the ink is discharged from the discharge ports 13 by using pressures of the bubbles. In other words, the heaters (pressure generation elements) 15 generate energy to be used for the discharge.

The heating elements 5 are disposed on the recording element board 10. It is possible to apply heat to and keep the heat of the recording element board 10 and the ink by using the heating elements 5. The heating with the heating elements 5 does not contribute to generation of any bubbles in the ink. Meanwhile, the drivers 6 drive and heat the heating elements 5 in response to heating signals. In addition, the temperature detection elements 9 are provided to the recording element board 10. The temperature detection elements 9 detect temperatures of the substrate and the like in the course of heating control by the above-described heating elements 5, and feed signals indicating the detected temperatures to the heating control unit 1004. In this embodiment, heating areas (also referred to as "divided areas") 55 are defined on the recording element board 10 each by use of a predetermined number of the heaters 15 (and/or the discharge ports 13 and so forth). Then, the temperature control to be described later with reference to FIGS. 5A and 5B is conducted for each of the heating areas 55. As shown in FIG. 3A, each heating area 55 is provided with one heating element 5 and one temperature detection element 9. As an example for defining the divided areas, a region provided with one driver 6 will be defined as one region in this embodiment.

Figure 4:
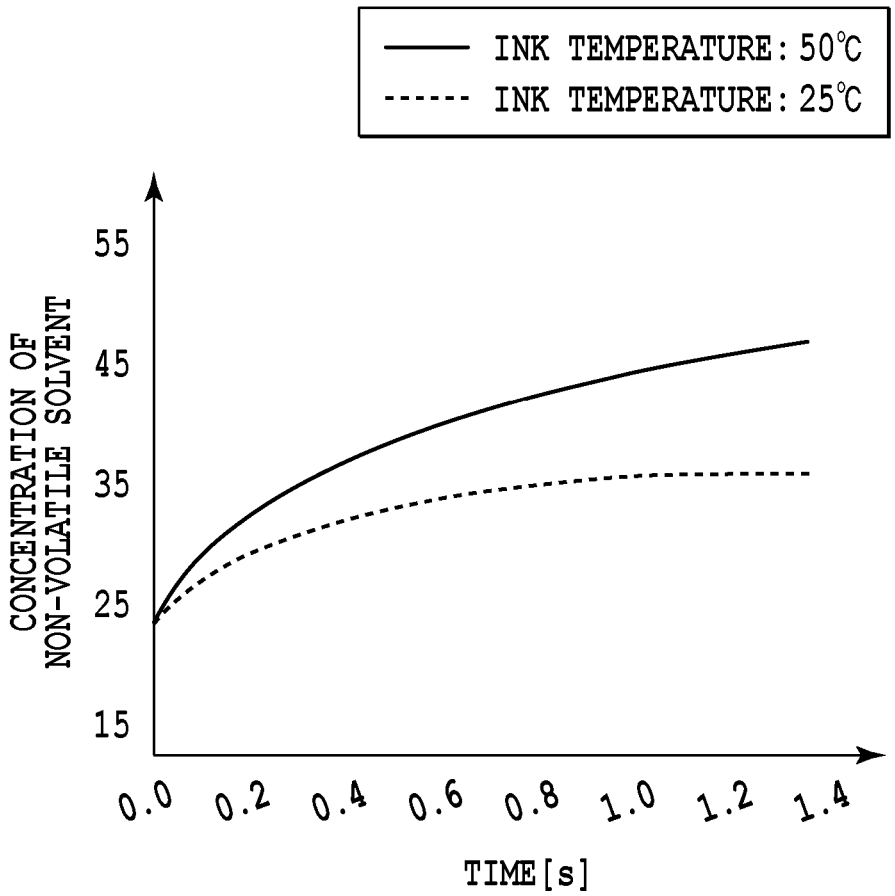
FIG. 4 is a graph showing aspects of changes in concentration of a non-volatile component contained in an ink inside a pressure chamber with time, the changes being attributed to heating of the liquid discharge head associated with temperature control.

FIG. 4 is a graph showing aspects of changes in concentration of a non-volatile component contained in the ink inside the pressure chamber with time, in which the changes are attributed to the heating of the liquid discharge head associated with the temperature control. FIG. 4 depicts the changes in the pressure chamber that does not perform discharge. As shown in FIG. 4, the ink in the pressure chamber where a discharge operation does not take place causes more evaporation of a volatile component therein as its temperature is higher. As a consequence, the concentration of a solvent is increased. On the other hand, in the pressure chamber where the discharge operation takes place, the ink is discharged before the concentration of the solvent is increased. Accordingly, the phenomenon shown in FIG. 4 does not occur in this case. When the ink in the pressure chamber where the discharge operation does not take place is also subjected to the application of heat in the course of the temperature control of the liquid discharge heads, the temperature of the ink is raised and the concentration of the solvent in the ink is increased as a consequence. For this reason, there may be a case of deterioration in quality of a recorded image as mentioned previously. In this embodiment, the temperature control using the heating element 5 is not performed on the pressure chamber where the discharge operation does not take place. In other words, the temperature of the pressure chamber that performs discharge is controlled within a predetermined temperature range, while the pressure chamber that does not perform discharge is kept from being subjected to the temperature control using the heating element so as to prevent the deterioration in quality of a recorded image.

Figure 5A:
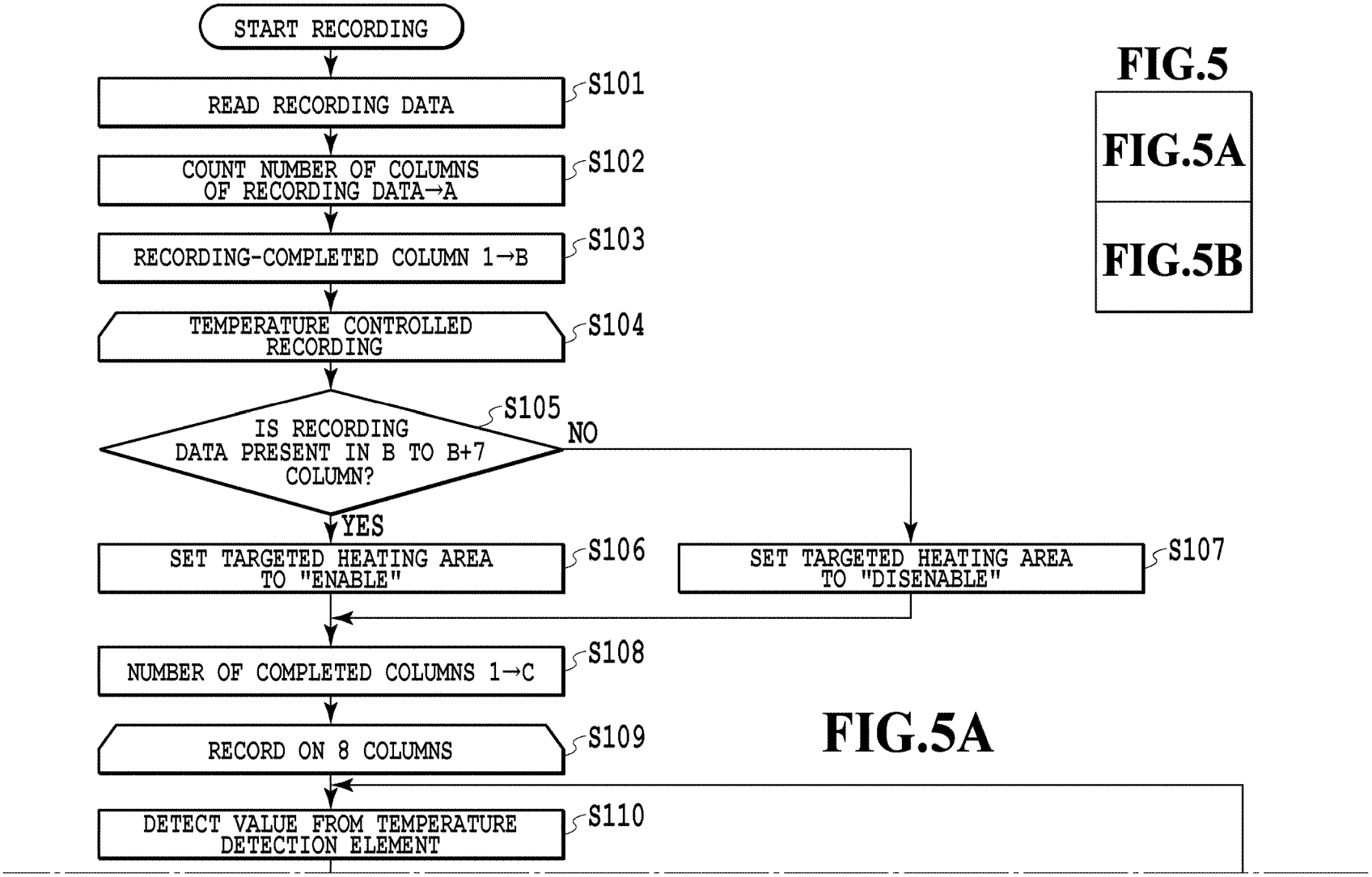
FIGS. 5A and 5B together form a flowchart showing a recording operation involving the temperature control according to the first embodiment of the present invention.
Figure 5B:
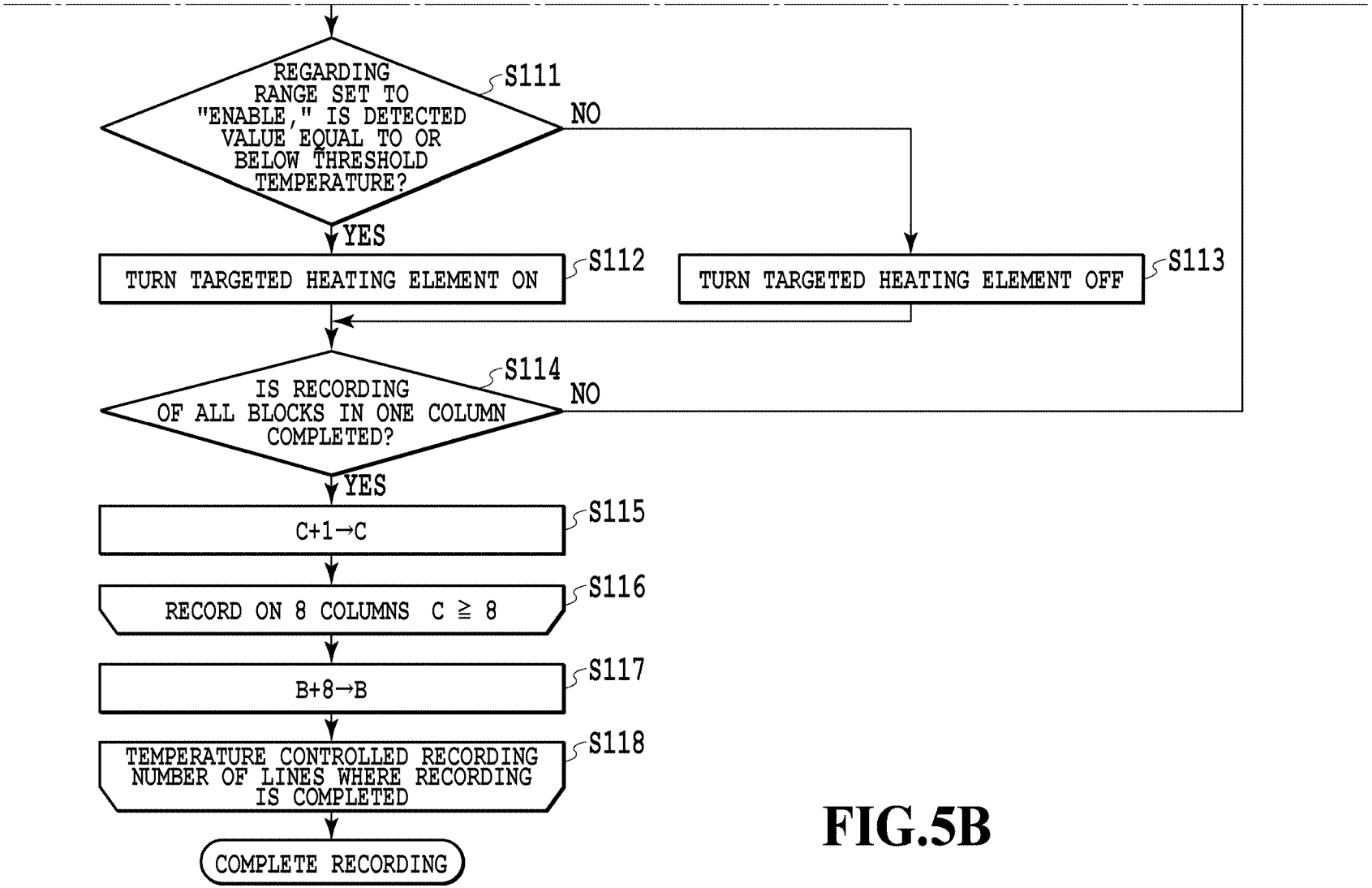
Figure 6A:
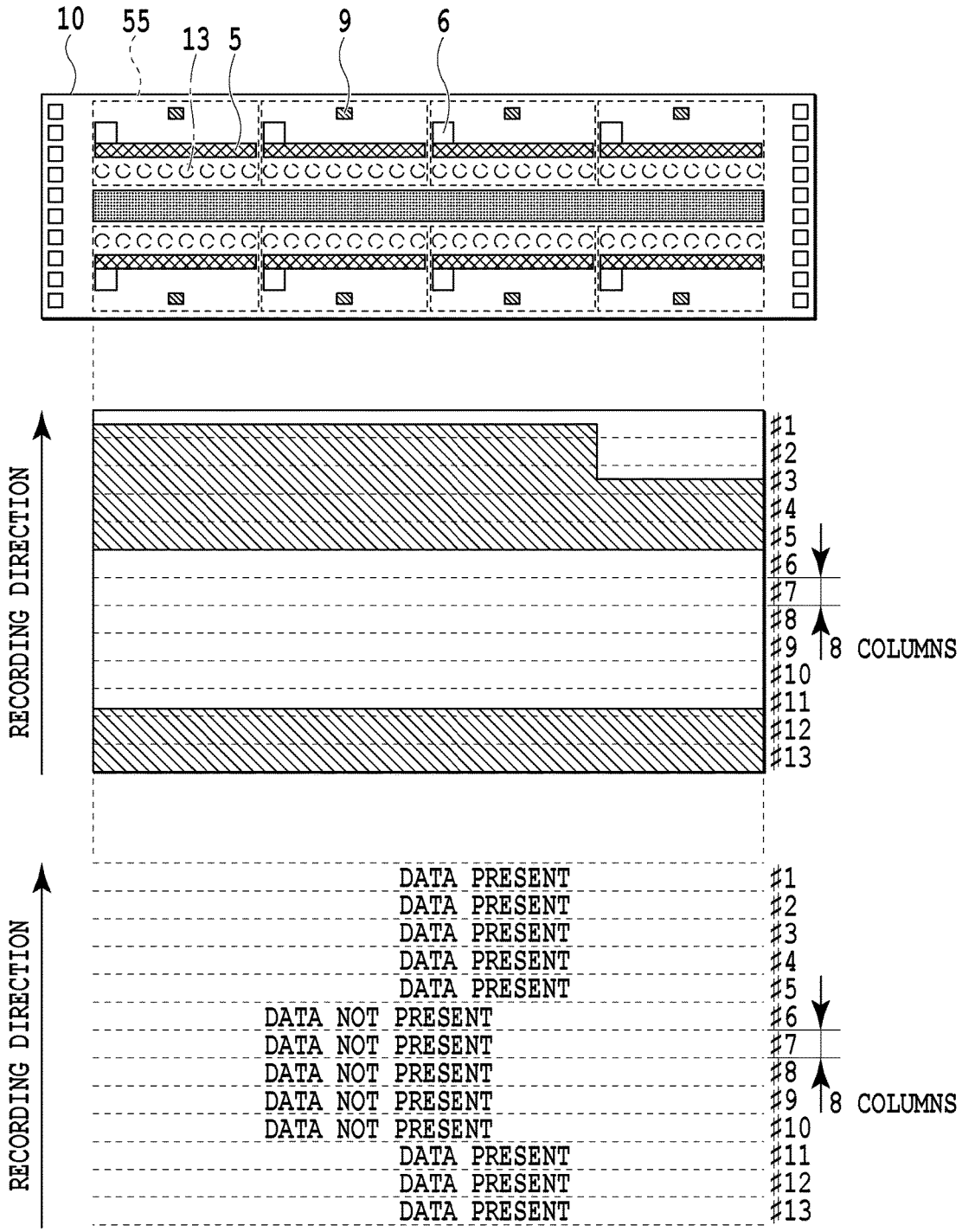
FIGS. 6A and 6B are diagrams describing heating ranges relative to discharge port ranges corresponding to recording data in the temperature control shown in FIGS. 5A and 5B.
Figure 6B:
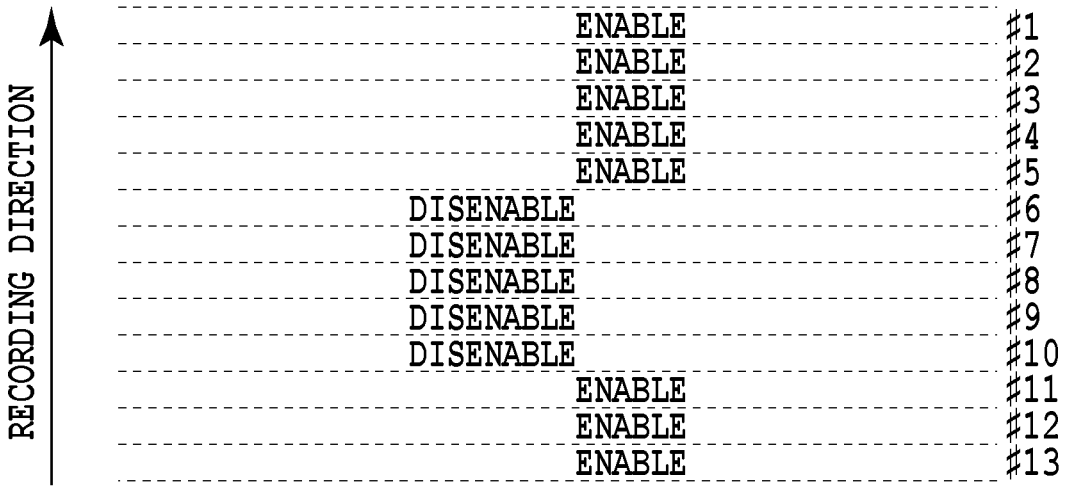

FIGS. 5A and 5B together form a flowchart showing the recording operation involving the temperature control according to the first embodiment of the present invention. Meanwhile, FIGS. 6A and 6B are diagrams describing heating ranges relative to discharge port ranges corresponding to recording data in the temperature control shown in FIGS. 5A and 5B.

In FIGS. 5A and 5B, when the recording is started, the heating control unit 1004 reads the recording data from the corresponding recording data buffer 1006 (FIG. 2) (S101). The heating control unit 1004 counts the number of lines of the recording data, and sets the number of lines to a value of a parameter A (S102). Here, the lines mean the data corresponding to a portion of the recording data equivalent to the discharge ports on one column of the recording element board 10. In the following, the lines are also referred to as columns. Specifically, one line corresponds to one column. Note that the parameter A is used for determination of completion of the flowchart of FIGS. 5A and 5B.

Next, the heating control unit 1004 sets a value 1, which indicates a first column of the recording data read in step S101, to a value of a column parameter B (S103). The steps so far correspond to initial processing. Next, in step S104, the heating control unit 1004 starts record processing involving the temperature control (which is indicated as "temperature controlled recording" in FIGS. 5A and 5B). The heating control unit 1004 determines whether the recording data are present in eight columns from the parameters B to B+7 (S105). Specifically, in the first processing in step S105, the heating control unit 1004 determines whether there is the recording data in any one of the first to eighth columns. In this embodiment, eight columns are collectively referred to as a column range. The column range will be described with reference to FIG. 6A. The column range is a unit representing a group of columns, and one column range is assumed to include eight columns in FIG. 6A. In the example shown in FIG. 6A, the recording data are present in column ranges #1 to #5 and column ranges #11 to #13 ("data present"). Here, one column range #k (where "k" indicates an arbitrary integer) includes the eight columns being a determination target in step S105 described above. Accordingly, the determination of presence of the recording data in step S105 is the processing to be carried out for each column range. Moreover, in this determination, the heating control unit 1004 determines that the recording data is present as long as the recording data is present not only in all the eight columns but just in one column, or even in part of such one column (see column ranges #1, #2, #3, and #11, for example) of the column range. Next, as shown in FIG. 6B, regarding each column range #k determined that the recording data is present therein, the heating control unit 1004 sets the heating area 55 on the recording element board 10 corresponding to the column #k as "enable" in step S106, and regarding any heating area 55 determined that no recording data is present ("data not present") therein, the heating control unit 1004 sets the heating area 55 as "disenable" in step S107. Next, the heating control unit 1004 controls the head drivers 30, and thus performs the control for starting the recording on the eight columns subjected to the above-described determination while setting a parameter C, which indicates the number of recorded columns, to an initial value of 1 (S109). Here, if it takes time to bring the column ranges that are set to "enable" to a control temperature by the heat application with the heating elements 5, then the column ranges may be set to "enable" at the timing before the elapse of such required time.

When the recording of the eight columns is started (S109), the heating control unit 1004 acquires the temperatures detected by the temperature detection elements 9 in the respective heating areas 55 along with the recording (S110). Thereafter, if the column ranges to be recorded (each including the eight columns) are set to "enable" in step S106, the heating control unit 1004 determines whether each detected temperature is equal or below a predetermined threshold in step S111. Then, when the detected temperature is determined to be equal to or below the predetermined threshold, the heating control unit 1004 performs heating by use of the heating elements 5 in the respective heating areas 55 (S112). On the other hand, when the detected temperature is higher than the predetermined threshold, the heating control unit 1004 does not perform heating by use of the heating elements 5 (S113). Here, if the column ranges to be recorded are set to "disenable" in step S107, the heating control unit 1004 does not perform heating by use of the heating elements 5 regardless of the detected values of the respective temperature detection elements 9. In step S114, the heating control unit 1004 determines whether the drive (ink discharge) of all the blocks is completed in the light of the discharge ports in the arrays of the discharge ports when performing time-shared drive on the arrays of the discharge ports in the recording element board 10. If the drive of all the blocks is not completed, the processing from step S110 onward is repeated.

When the ink discharge operation from the discharge ports corresponding to one column is completed, the heating control unit 1004 increments the value of the parameter C indicating the number of recorded columns by one (S115), and then determines whether the recording of the eight columns is completed (S116). If the recording of the eight columns is not completed, the processing from step S109 onward is repeated. If the recording of the eight columns is completed, the heating control unit 1004 increments the value of the column parameter B by one column range (i.e., by eight columns) (S117). The heating control unit 1004 compares the parameter A set in step S102 with the parameter B, and thus determines whether the recording of the number of lines to be recorded is completed (S118). When the recording of the number of lines is completed, the recording processing is terminated. If the recording of the number of lines is not completed, the processing from step S103 onward is repeated.

By performing the above-described temperature control, the heat is not applied to the column range that does not include any recording data in one line. Thus, it is possible to suppress evaporation of a volatile component in the ink from any discharge ports where the discharge does not take place. This embodiment employs the heating elements for the temperature control, which are provided separately from the heaters for generating bubbles and discharging the ink. However, the application of the present invention is not limited only to this aspect. For example, the heating elements may also function as the discharge heaters as long as such a configuration is consistent in principle. In the meantime, in terms of the supply port, this embodiment describes the example in which one supply port is provided corresponding to the multiple pressure chambers. However, it is clear that the effect of this embodiment can also be achieved in a configuration in which multiple supply ports are separately provided to the multiple pressure chambers.

(Second Embodiment)

A second embodiment of the present invention relates to temperature control of liquid discharge heads configured such that ink supply ports and arrays of discharge ports for C, M, Y, and Bk inks, respectively, are provided on one recording element board. When using such recording element board, there are several recording modes applicable, including: a mode using only the inks of three colors of C, M, and Y; a black and white mode using only the Bk ink; and a mode using all the inks of four colors. When the black and while mode is executed, for example, the arrays of discharge ports for the other three colors are not subjected to the discharge operation. Accordingly, there is no need to perform the temperature control of the arrays of discharge ports (the heating areas) where the discharge operation does not take place. For this reason, the heating control unit 1004 of this embodiment sets the column ranges, which correspond to the heating areas 55 equivalent to the arrays of discharge ports where the discharge operation does not take place, to "disenable."

Figure 7A:
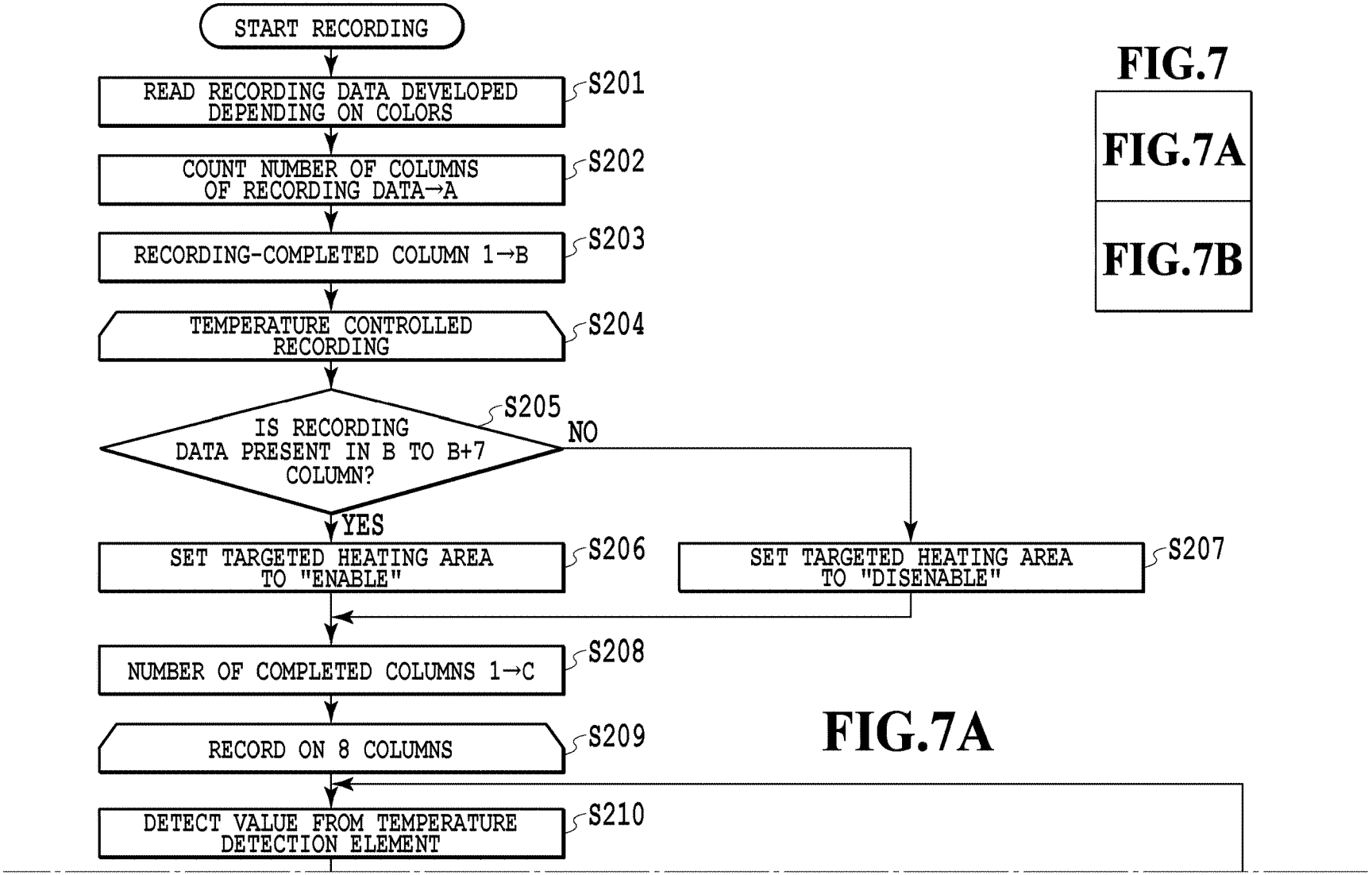
FIGS. 7A and 7B together form a flowchart showing a recording operation involving the temperature control according to a second embodiment of the present invention.
Figure 7B:
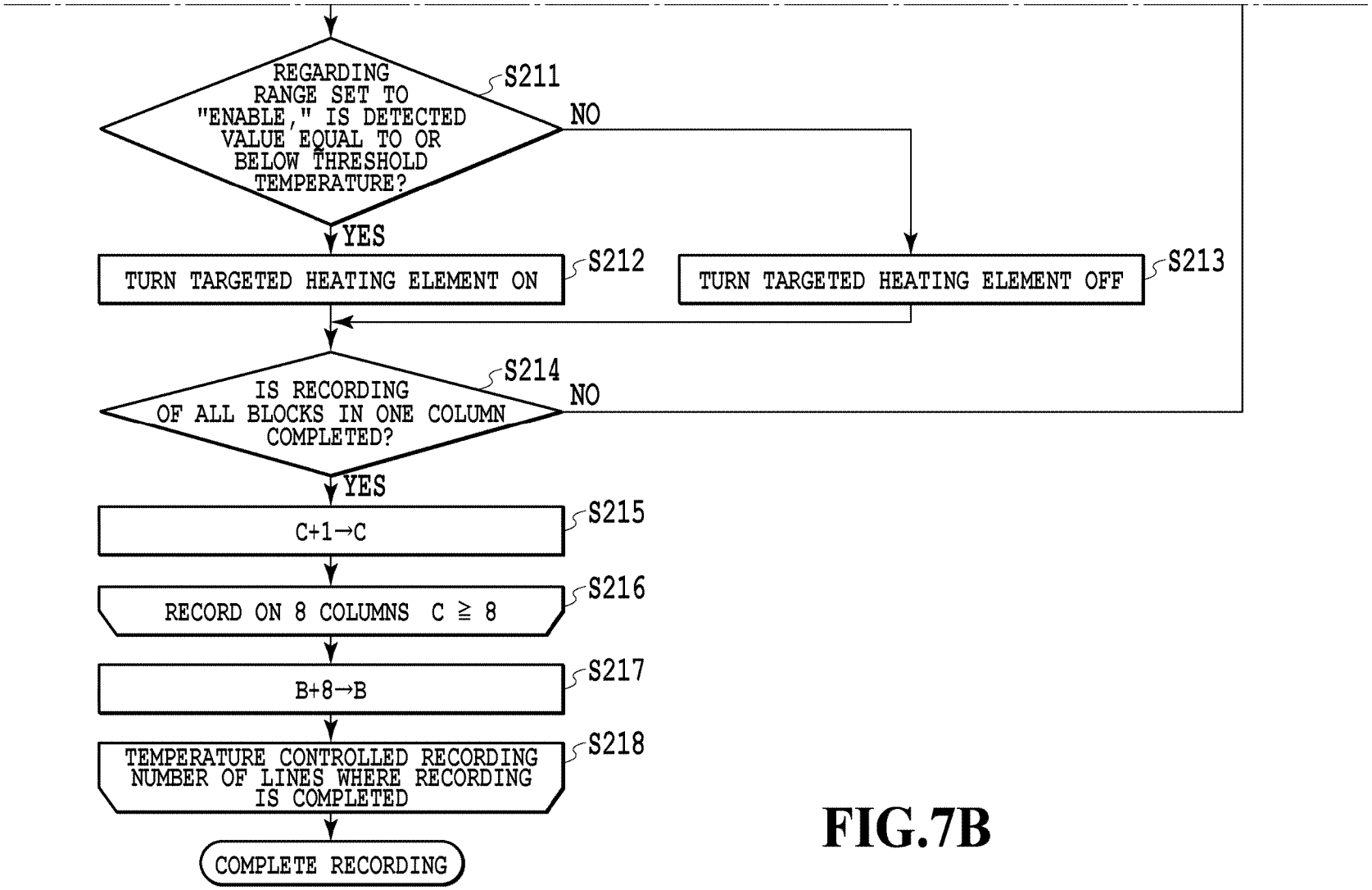
Figure 8A:
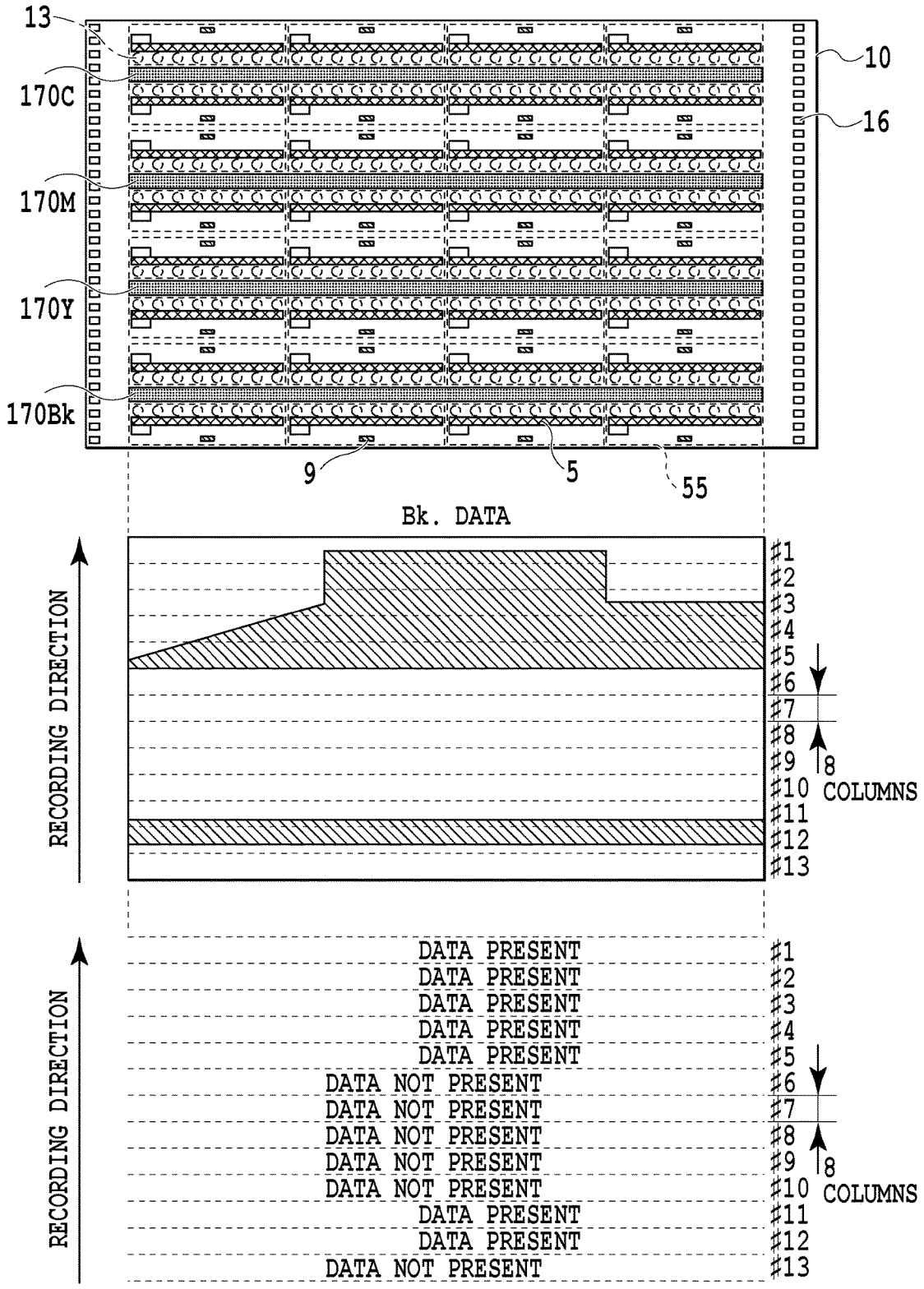
FIGS. 8A and 8B are diagrams describing heating ranges relative to discharge port ranges corresponding to recording data in the temperature control shown in FIGS. 7A and 7B.
Figure 8B:
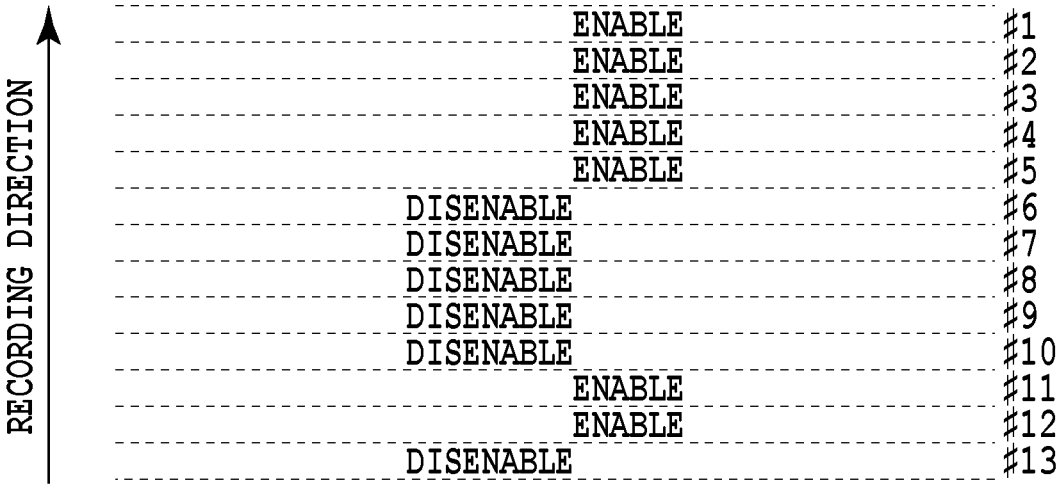

FIGS. 7A and 7B together form a flowchart showing a recording operation involving the temperature control according to the second embodiment of the present invention. Meanwhile, FIGS. 8A and 8B are diagrams describing heating ranges relative to discharge port ranges corresponding to recording data in the temperature control shown in FIGS. 7A and 7B. In FIGS. 7A and 7B, when the recording is started, the heating control unit 1004 reads the recording data developed depending on the ink colors in step S201. Thereafter, in the processing from step S202 onward, the heating control unit 1004 performs the same processing as the processing according to the first embodiment shown in FIGS. 5A and 5B in terms of each ink color. The example shown in FIGS. 8A and 8B illustrates the heating range in the black and white mode where only the recording with the Bk ink takes place. In this case, the heating control unit 1004 performs the heating control of the heating areas 55 for the Bk ink, which are set to "enable."

As described above, according to this embodiment, it is possible to execute the temperature control appropriately in the case of the liquid discharge head employing the recording element board integrated for the multiple colors. Particularly, depending on the recording mode, it is possible to omit the temperature control of the arrays of discharge ports (the heating areas) regarding the ink colors not subjected to the discharge operation, for example. In this way, it is possible to suppress evaporation of a volatile component regarding the relevant arrays of discharge ports. This embodiment determines the "enable/disenable" setting of each heating area 55 based on the presence of the recording data. However, there may also be a case such as a situation at a low environmental temperature, where the temperature in a desired area is not raised to the control temperature. In such a case, the following control may also be additionally conducted. Specifically, when a certain heating area 55 is determined as containing the recording data, then the heating areas 55 around the certain heating area 55 may also be set to "enable." In other words, the heating control unit 1004 may set the heating areas 55, which are located around the heating area 55 determined as containing the recording data, to "enable" depending on the environmental temperature.

(Third Embodiment)

Figure 9:
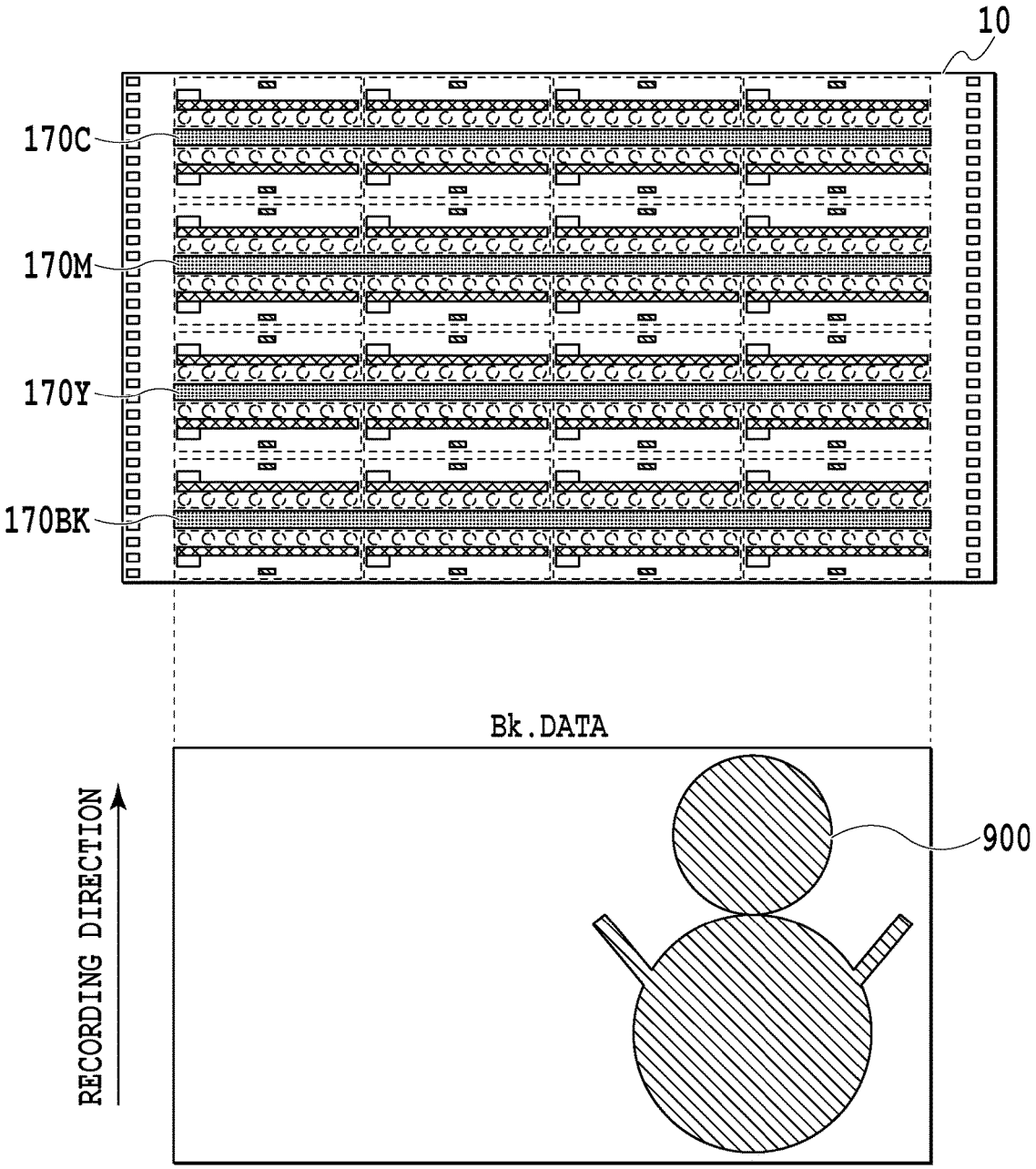
FIG. 9 is a diagram showing an example of image data according to a third embodiment of the present invention, in which there is a region to be recorded across a recording direction while including a relatively large blank area where the printing does not take place.

A third embodiment of the present invention relates to an aspect in which the heating control unit 1004 determines the presence of the recording data in accordance with a temporal sequence (depending on the column ranges) of the recording operation as in the respective embodiments described above, and also depending on the heating areas on the recording element board 10. As shown in FIG. 9, in the case of recording image data in which there is a region 900 to be recorded across a recording direction (in a column array direction) while including a relatively large blank area where the printing does not take place, the heating control unit 1004 of any of the above-described embodiments sets all the columns containing the region 900 to "enable" representing that the recording data is present. In this case, the heat is applied to all the columns containing the region 90 although there is the relatively large blank area in the columns where the inks need not be discharged. For this reason, it is not possible to achieve the sufficient effect of the above-described embodiments in this case. Accordingly, in this embodiment, the heating control unit 1004 decides whether it is appropriate to execute the temperature control by determining the presence of the recording data depending on the multiple heating areas 55 arranged in the direction of the arrays of discharge ports on the recording element board 10.

Figure 10A:
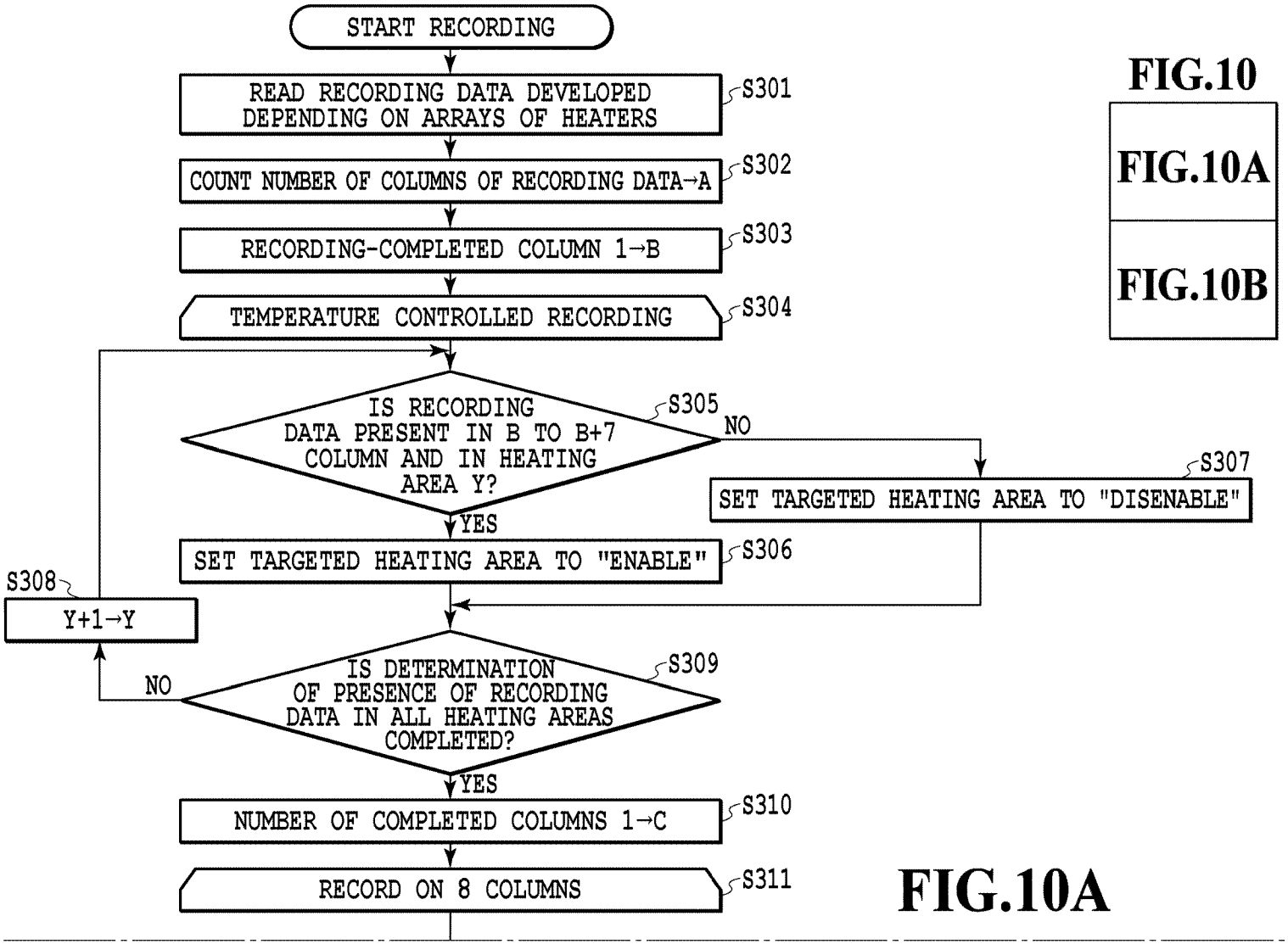
FIGS. 10A and 10B together form a flowchart showing a recording operation involving the temperature control according to a third embodiment of the present invention.
Figure 10B:
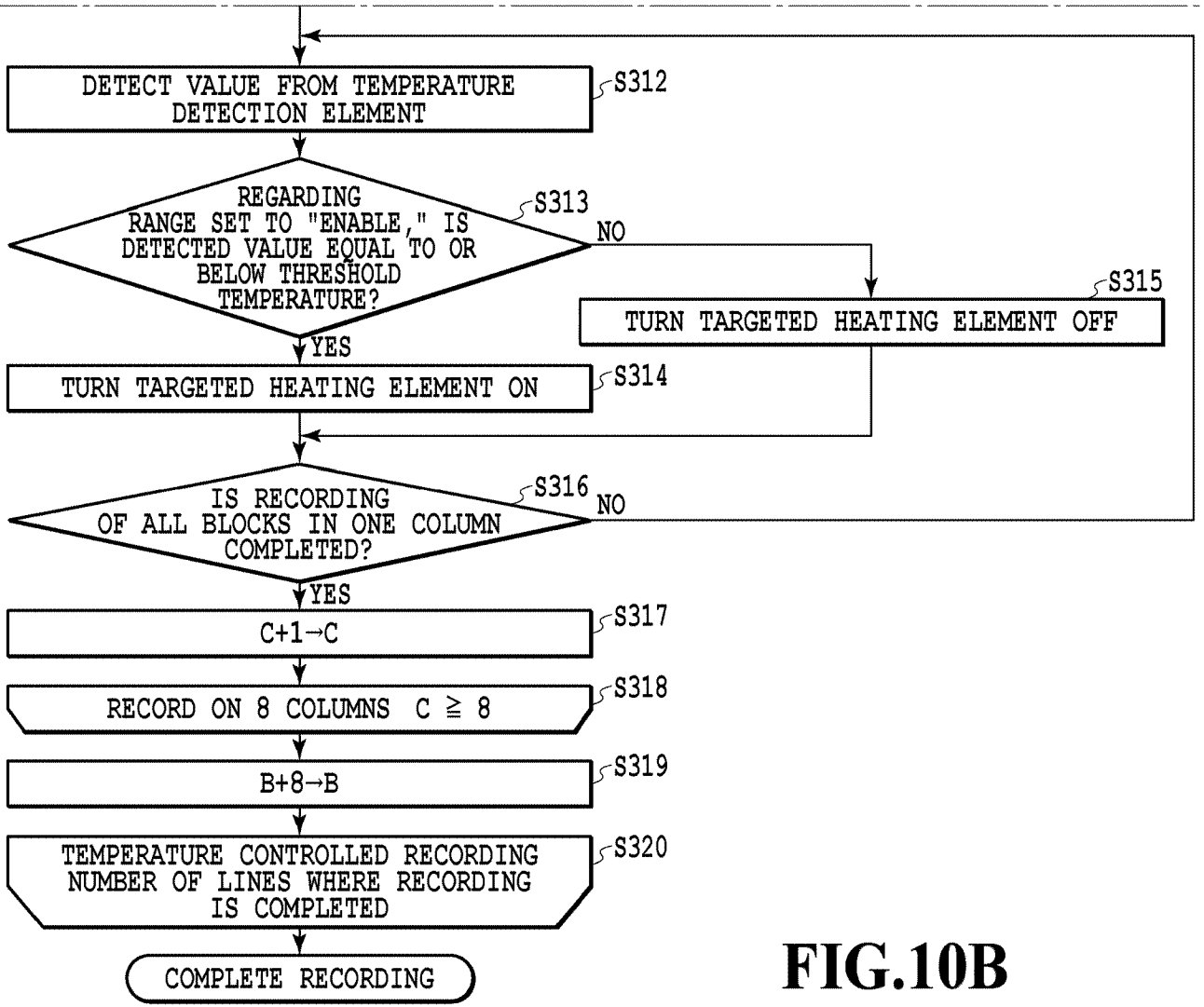
Figure 11A:
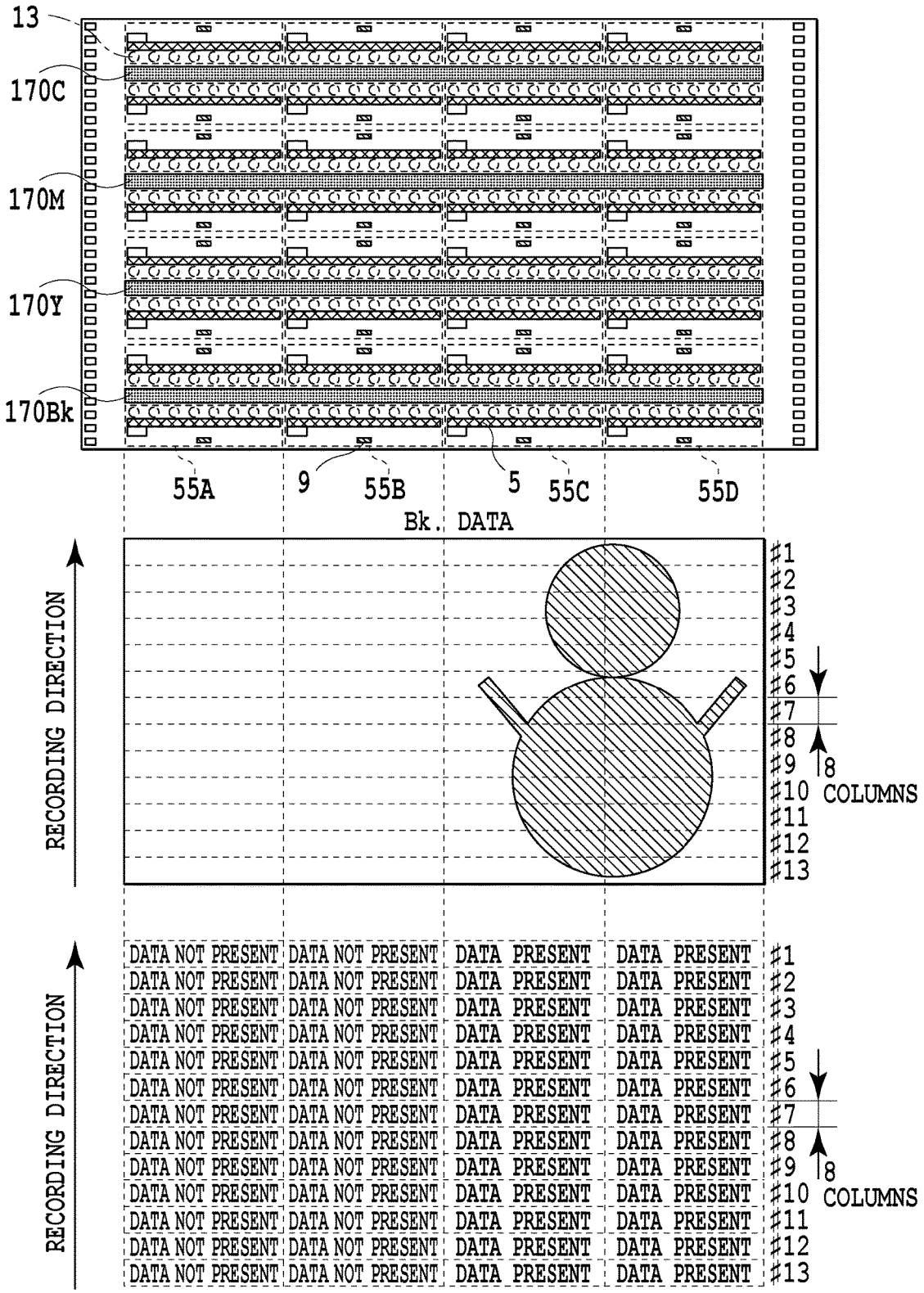

FIGS. 10A and 10B together form a flowchart showing a recording operation involving temperature control according to the third embodiment of the present invention. Meanwhile, FIGS. 11A and 11B are diagrams describing heating ranges relative to discharge port ranges corresponding to recording data in the temperature control shown in FIGS. 10A and 10B.

The heating control unit 1004 of this embodiment is configured to determine the presence of recording data depending on the arrays of heaters (or depending on the heating areas) in the column ranges, and to perform the temperature control based on the determination. Using a flowchart shown in FIGS. 10A and 10B, a description will be given below of features of this embodiment which are different from the processing according to the first embodiment shown in FIGS. 5A and 5B or the processing according to the second embodiment shown in FIGS. 7A and 7B. First, the heating control unit 1004 reads the recording data developed depending on the arrays of the heaters (or depending on the heating areas) in step S301. Thereafter, the heating control unit 1004 performs the same processing as the processing of the above-described embodiments. Then, in the determination of presence of the recording data in step S305, the heating control unit 1004 of this embodiment determines the presence of the recording data regarding each column range that includes the eight columns. Here, the heating control unit 1004 determines the presence of the recording data depending on the divided areas in each column range, which correspond to multiple heating areas 55A to 55D (see FIG. 11A) arranged in the direction of the arrays of discharge ports on the recording element board 10. As a consequence, the heating control unit 1004 performs the processing to set each of the divided areas in the column ranges to be processed to "disenable" or "enable" in steps S306 and S307 (see FIG. 11B). The determination based on the divided areas is performed sequentially in accordance with a heating area position parameter Y (S309, S308). Specifically, although it is not illustrated in FIGS. 10A and 10B, processing to initialize the position parameter Y to 1 is performed after step S304, and the determination as to whether the recording area is present in the heating area Y is performed in step S305. Thereafter, if the determination of step S305 is yet to be performed on all the heating areas, the position parameter Y is updated and the processing in step S305 is repeated. When the determination in terms of all the divided areas is completed (S309), the processing from step S310 onward is performed. This processing is the same as the processing explained in conjunction with the first embodiment or the second embodiment.

Here, if the regions set to "enable" and the regions set to "disenable" are mixed in the same array of the discharge ports, there may be a case such as a situation in which the device is installed at a low environmental temperature, for example, where the temperature in a certain heating area 55 set to "enable" does not reach the control temperature. In such a case, a step of setting the heating areas 55, which are located around the certain heating area determined as containing the recording data, to "enable" may be added. Thus, it is possible to conduct more delicate temperature control, and to effectively suppress evaporation from the discharge ports.

(Fourth Embodiment)

A fourth embodiment of the present invention relates to a liquid discharge head having a different structure from those of the above-described first to third embodiments, which is configured to circulate an ink stored inside a pressure chamber in a liquid discharge head by generating a flow of the ink from one side to the other side of the pressure chamber. Specifically, the liquid discharge head of this embodiment is a liquid discharge head having a structure to circulate the liquid between the inside and the outside of the pressure chamber.

Figure 12A:
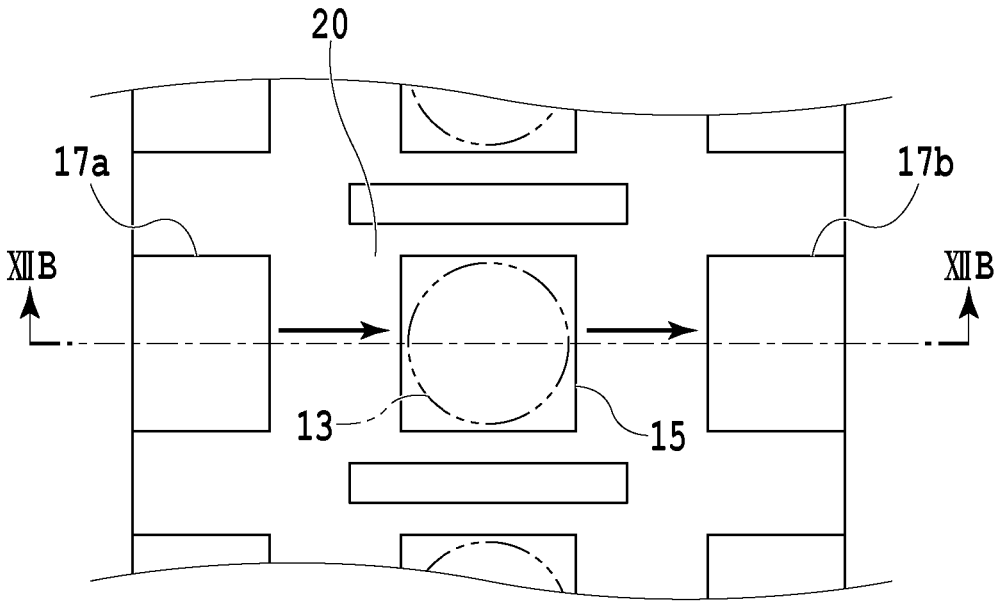
FIGS. 12A and 12B are views showing a structure around a certain pressure chamber in a liquid discharge head according to a fourth embodiment of the present invention.
Figure 12B:
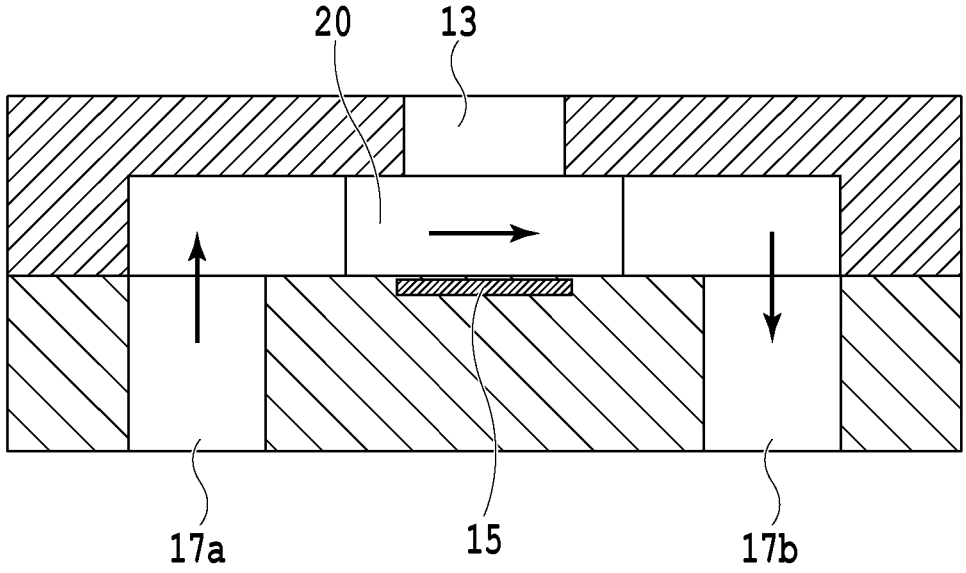

FIGS. 12A and 12B are views showing a structure around a certain pressure chamber in the liquid discharge head of this embodiment. FIG. 12B shows a cross section taken along XIIB-XIIB line in FIG. 12A. As shown in these drawings, the liquid discharge head of this embodiment is provided with a supply individual flow channel 17*a* and a recovery individual flow channel 17*b* formed as holes in the board, respectively, on two sides of each pressure chamber 20 being provided with the heater 15 and communicating with the corresponding discharge port 13. The supply individual flow channel 17*a* is a hole for supplying the ink to the pressure chamber 20, and the recovery individual flow channel 17*b* is a hole for draining the ink from the pressure chamber 20. Thus, in the pressure chamber 20 where the discharge operation involving the drive of the heater does not take place, in particular, the ink is circulated in such a way as to be supplied from the supply individual flow channel 17*a* into the pressure chamber 20 and then drained from the pressure chamber 20 through the recovery individual flow channel 17*b*. Note that while the above-mentioned circulating flow of the ink occurs when the heater 15 is not driven, the circulating flow is also continuously generated when the heater 15 is driven to discharge the ink. In other words, the heater is driven so as to discharge the ink in the state where the ink inside the pressure chamber 20 is flowing. In the case of the liquid discharge head having the above-described configuration, it is possible to constantly supply the fresh ink into the pressure chamber, and thus to maintain the components of the ink inside the pressure chamber constant. However, since the ink of the initial composition ratio keeps flowing in, the ratio of the volatile component therein remains high and the amount of evaporation of the volatile component from the discharge ports is increased accordingly. As a consequence, the system of this embodiment, which is configured to recover the ink from the liquid discharge head and to supply the recovered ink again to the liquid discharge head 3, may cause a gradual change in composition ratio of the ink after a long period of use, thereby causing deterioration in quality of a recorded image.

Accordingly, as with the respective embodiments described above, this embodiment is configured to set the heating areas 55 to "enable" or "disenable" based on the recording data, and to perform the on-off control of the corresponding heating elements 5 based on the values of the temperature detection elements 9 corresponding to the heating areas 55 that are set to "enable." Here, regarding the range of determination based on the recording data, it is possible to apply any of the recording element board basis, the heater array basis, and the heating area basis. According to this configuration, it is possible to suppress the amount of evaporation from the liquid discharge heads as a whole even when adopting the head structure involving the circulation in the pressure chambers which increases the amount of evaporation, and to record the high-quality image as a consequence.

(Fifth Embodiment)

Figure 13A:
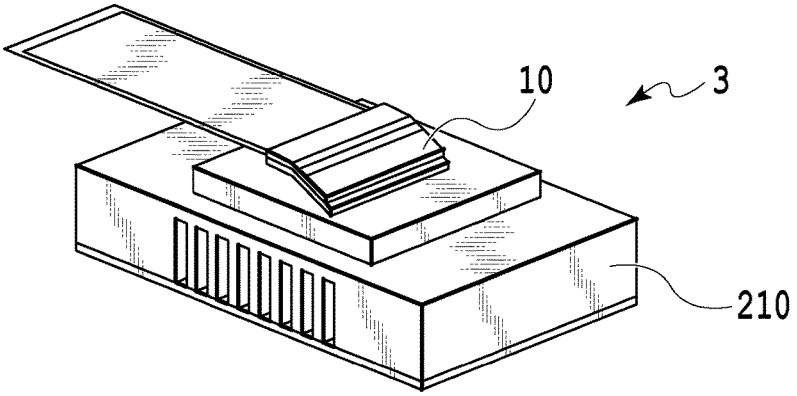
FIGS. 13A and 13B are views showing a liquid discharge head according to a fifth embodiment of the present invention.
Figure 13B:
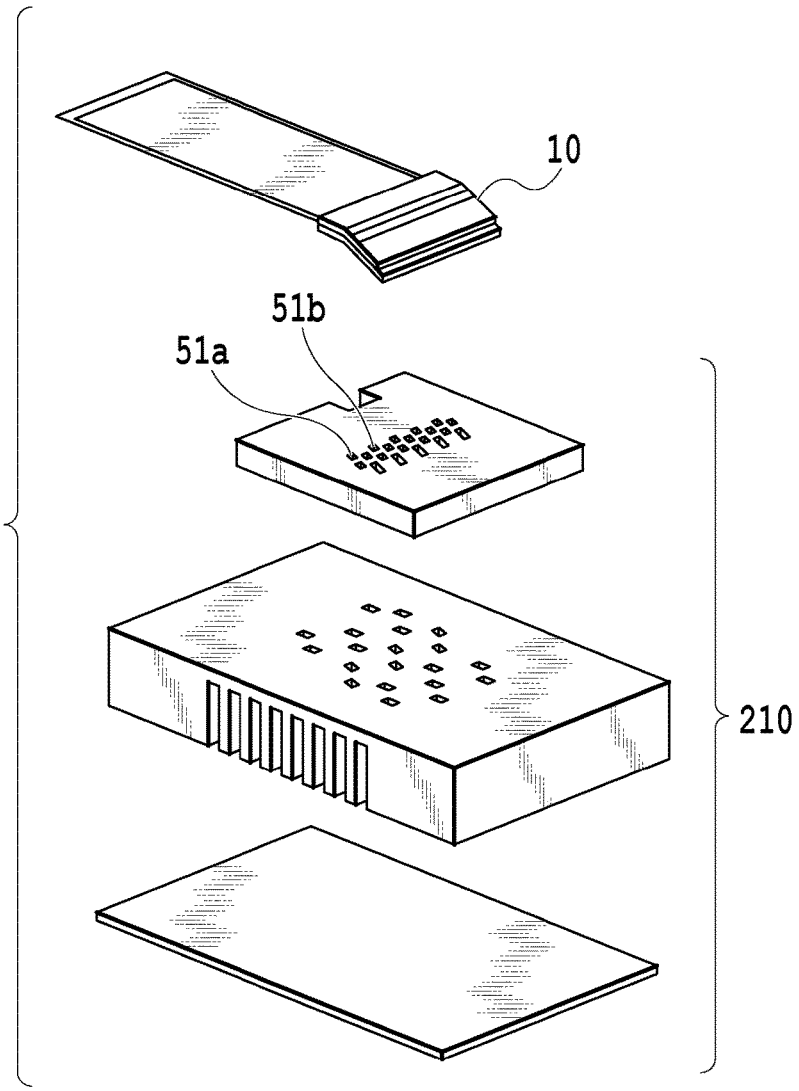
Figure 14:
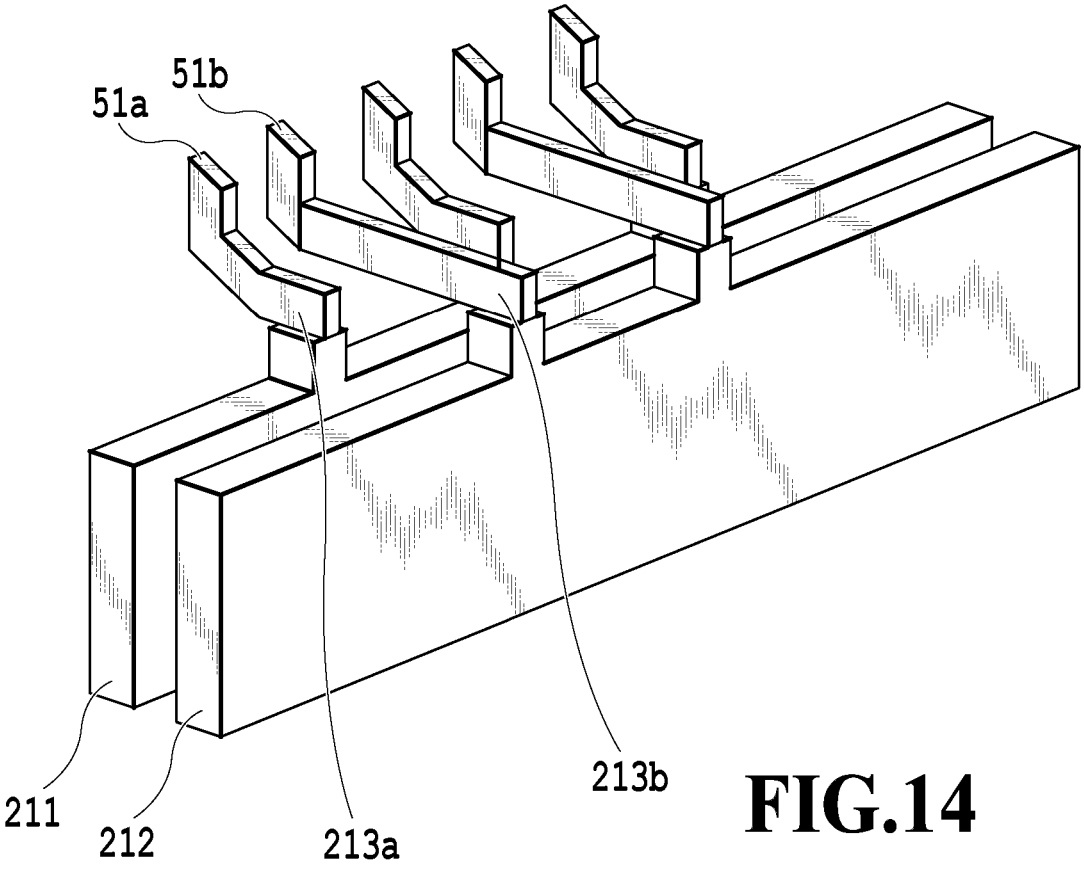
FIG. 14 is a view showing extracted flow channels formed inside the liquid discharge head according to the fifth embodiment.

FIGS. 13A and 13B are views showing a liquid discharge head according to a fifth embodiment of the present invention. FIG. 13B is a view illustrating its components in a disassembled state. The liquid discharge head 3 at least includes the recording element board 10 and a flow channel member 210 which supports the recording element board. In the example shown in FIGS. 13A and 13B, the member located below the recording element board 10 consists of three components. However, the components may be of any number so far as such components can collectively achieve the objective which is to supply the ink from the flow channel member 210 to the recording element board 10. FIG. 14 is a view showing a common supply flow channel 211 and a common recovery flow channel 212 for one color, and branched supply flow channels 213*a* and 213*b* communicating with the common supply flow channel 211 and the common recovery flow channel 212, respectively, which are extracted from flow channels formed inside the liquid discharge head 3 of this embodiment.

When the discharge operation takes place in the above-described head structure, the ink flows into the individual flow channels inside the recording element board 10 through communication holes 51*a* of the respective branched flow channels. In this case, when the ink in the vicinity of the pressure chamber and the recording element board 10 is subjected to the temperature control by using the heating element 5, the ink flowing in has a relatively lower temperature than the ink in the vicinity of the pressure chamber and the recording element board 10. On the other hand, the ink having flowed in through the communication holes 51*a* flows inside the individual flow channel in a longitudinal direction thereof, and receives the heat from the recording element board 10 and is thus heated. Accordingly, the temperature of the ink becomes higher as the flowing distance from the communication holes 51 is longer. As a result, when a certain heating area 55 on the recording element board 10 covers a region across the multiple communication holes 51, the temperature of the ink heated with the heating element varies from place to place, whereby evaporation may be accelerated at a high-temperature part. Thus, discharge characteristics may vary even by using the same heater, and recording quality may be deteriorated as a consequence.

On the other hand, in this embodiment, in order to reduce a difference in temperature between a low-temperature part and a high-temperature part arising due to the locations of the communication holes 51, a heating area 55*a* that covers communication holes 51*a* communicating with the branched supply flow channels 213*a* and a heating area 55*b* that covers communication holes 51*b* communicating with the branched supply flow channels 213*b* are subjected to the temperature control separately from each other.

Figure 15A:
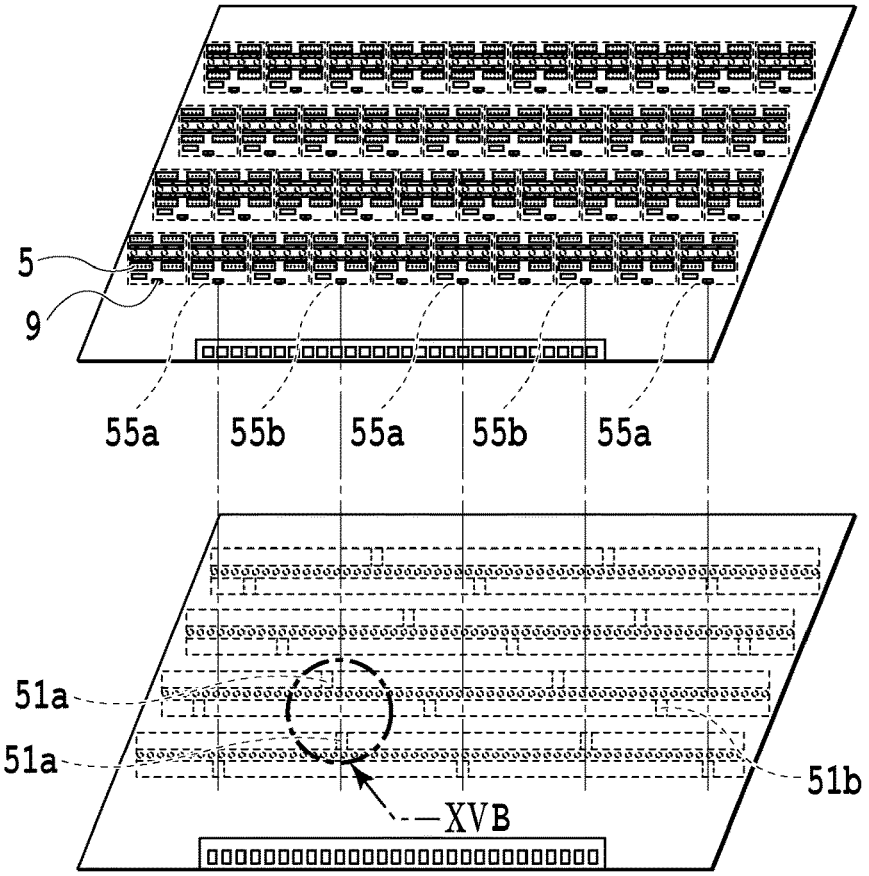
FIGS. 15A and 15B are views showing positional relations between communication holes and a heating area on a recording element board of the liquid discharge head according to the fifth embodiment of the present invention.
Figure 15B:
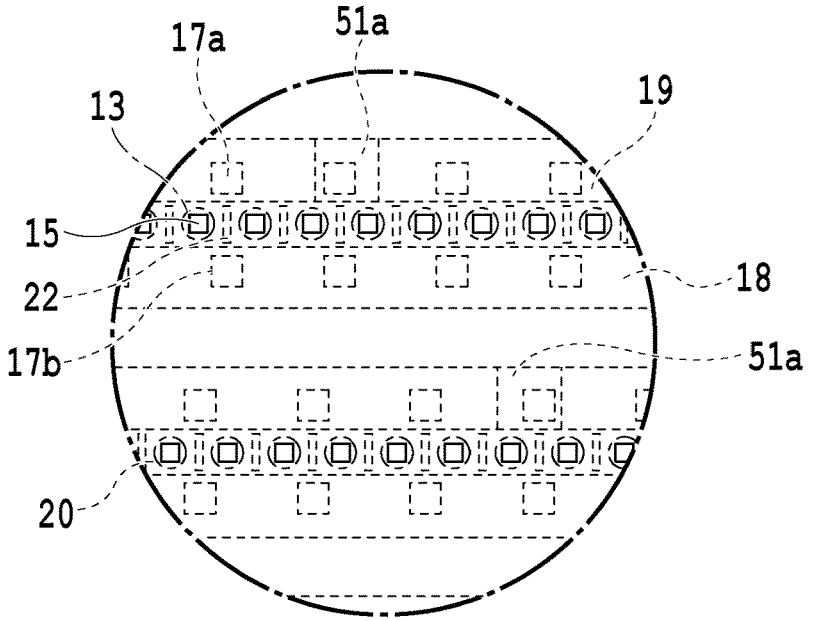

FIGS. 15A and 15B are views describing positional relations between the communication holes 51*a* and 51*b* and the heating areas on the recording element board of the liquid discharge head according to the fifth embodiment of the present invention. FIG. 15B is an enlarged view of an XVB portion indicated in FIG. 15A. An ink inside a liquid supply path 18 flows to a liquid recovery path 19 via supply individual flow channel 17*a*, the pressure chambers 20, and the recovery individual flow channel 17*b*. As shown in FIGS. 15A and 15B, the heating elements 5 and the temperature detection elements 9 are disposed in the heating areas 55. Moreover, each heating area 55 is set to "enable" or "disenable" based on the inputted recording data, and each heating element is subjected to on-off control in response to an output value from the corresponding temperature detection element 9. Thus, it is possible to maintain the ink in the vicinity of the discharge port only at a required location at a temperature around the control temperature. Here, regarding the range of determination based on the recording data, it is possible to apply any of the recording element board basis, the heater array basis, and the heating area basis. In the views illustrating this embodiment, the heating areas including the temperature detection elements 9 are also laid out at spaces between the communication holes 51. The adoption of this configuration leads to improvement in spatial resolution and promotes production of effect. However, this configuration is in a trade-off relationship with the circuit size. In this context, it is desirable to avoid excessive downsizing of the heating areas. The liquid discharge head of this embodiment includes the recording element board and the support member which supports the recording element board. Moreover, regarding the flow channels formed in the recording element board, the common flow channels formed in the support member, and the communication holes in the support member for establishing communication between the flow channels in the board and the common flow channels, the number of the heating elements 5 provided therein is equal to or larger than the number of the communication holes 51. Meanwhile, in the liquid discharge head, the multiple recording element boards are arranged on the support member, and the pressure generation elements enclosed between the adjacent recording element boards overlap one another in the conveyance direction of the record medium. The number of the heating elements arranged along an array direction of the discharge ports is smaller than the number of the pressure generation elements arranged along the array direction.

(Sixth Embodiment)

Figure 16A:
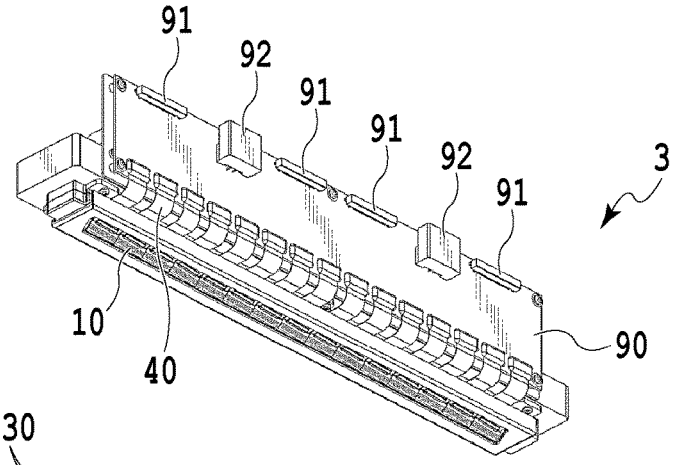
FIG. 16A is a perspective view and FIG. 16B is an exploded perspective view of a liquid discharge head according to a sixth embodiment of the present invention.
Figure 16B:
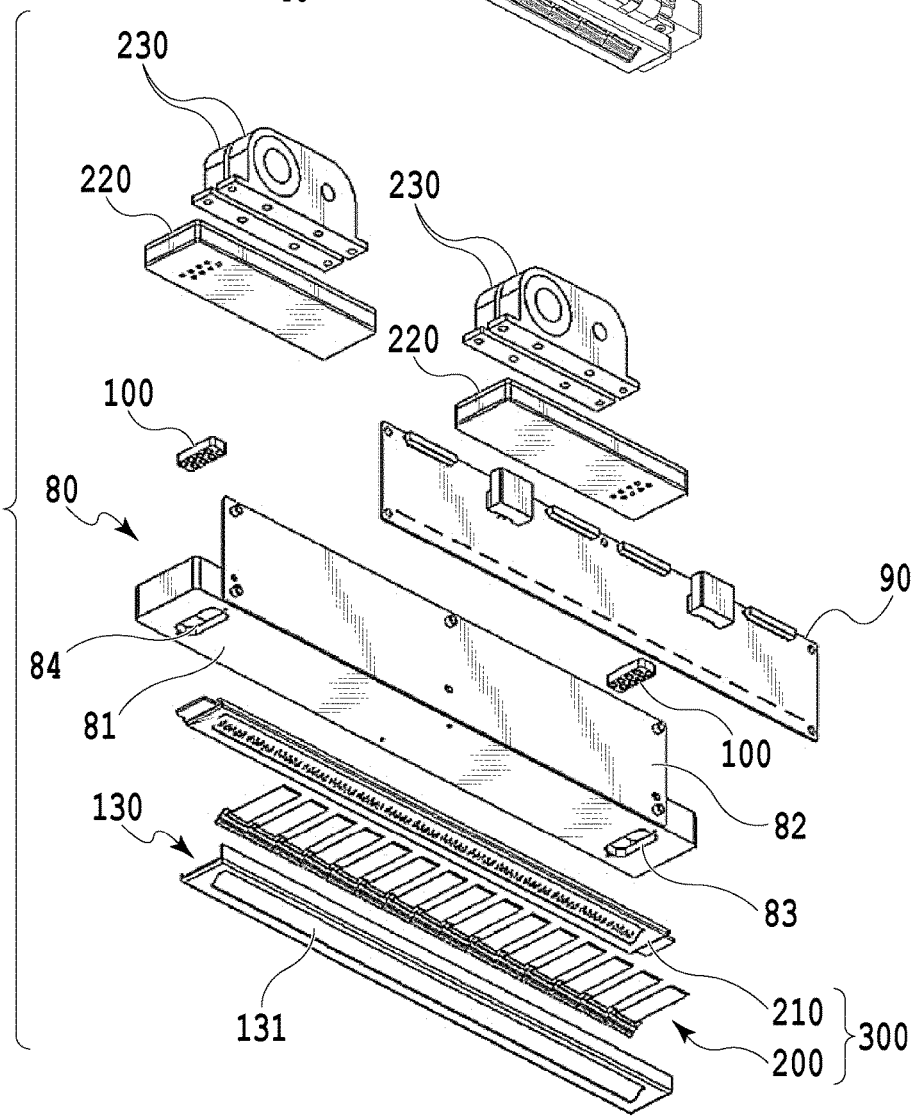

As with the above-described fourth and fifth embodiments, a sixth embodiment of the present invention relates to a liquid discharge head of an ink circulation-type structure. FIG. 16A is a perspective view and FIG. 16B is an exploded perspective view of the liquid discharge head 3 of this embodiment. The liquid discharge head 3 is a line-type liquid discharge head, on which multiple recording element boards 10 in the quantity enough for covering the recording area in a range equivalent to the width of the record medium to be conveyed are linearly arranged. The liquid discharge head 3 includes the recording element boards 10, and signal input terminals 91 and power supply terminals 92 which are electrically connected through a flexible wiring board 40 and an electric wiring board 90. A housing 80 is formed from a liquid discharge unit support 81 and an electric wiring board support 82. The liquid discharge unit support 81 is provided with openings 83 and 84 into which joint rubber members 100 are inserted. As shown in FIGS. 16A and 16B, a cover member 130 is a component having a frame-like surface provided with an elongated opening. A liquid discharge unit 300 is formed from multiple discharge modules 200 and a flow channel member 210. Discharge driving signals and electric power necessary for the discharge are supplied from the recording apparatus 1000 to the respective recording element boards 10 via the flexible wiring board 40 and the electric wiring board 90. In this configuration, thermal diffusivity of the flow channel member 210 is set smaller than thermal diffusivity of the recording element boards 10. Thus, the heat transfer from the respective recording element boards 10 to the ink flowing inside the common flow channel can be reduced. As a consequence, it is possible to keep the temperature of each recording element board 10 constant irrespective of the location thereof, and to homogenize the discharge characteristic of the ink to be discharged. Meanwhile, if there is a large amount of the recording data to be handled in a certain heating area, the electric power for heating the corresponding heating elements 5 may be reduced. On the other hand, if there is a small amount of the recording data to be handled in a certain heating area, the electric power for heating the corresponding heating elements 5 may be increased.

Figure 17:
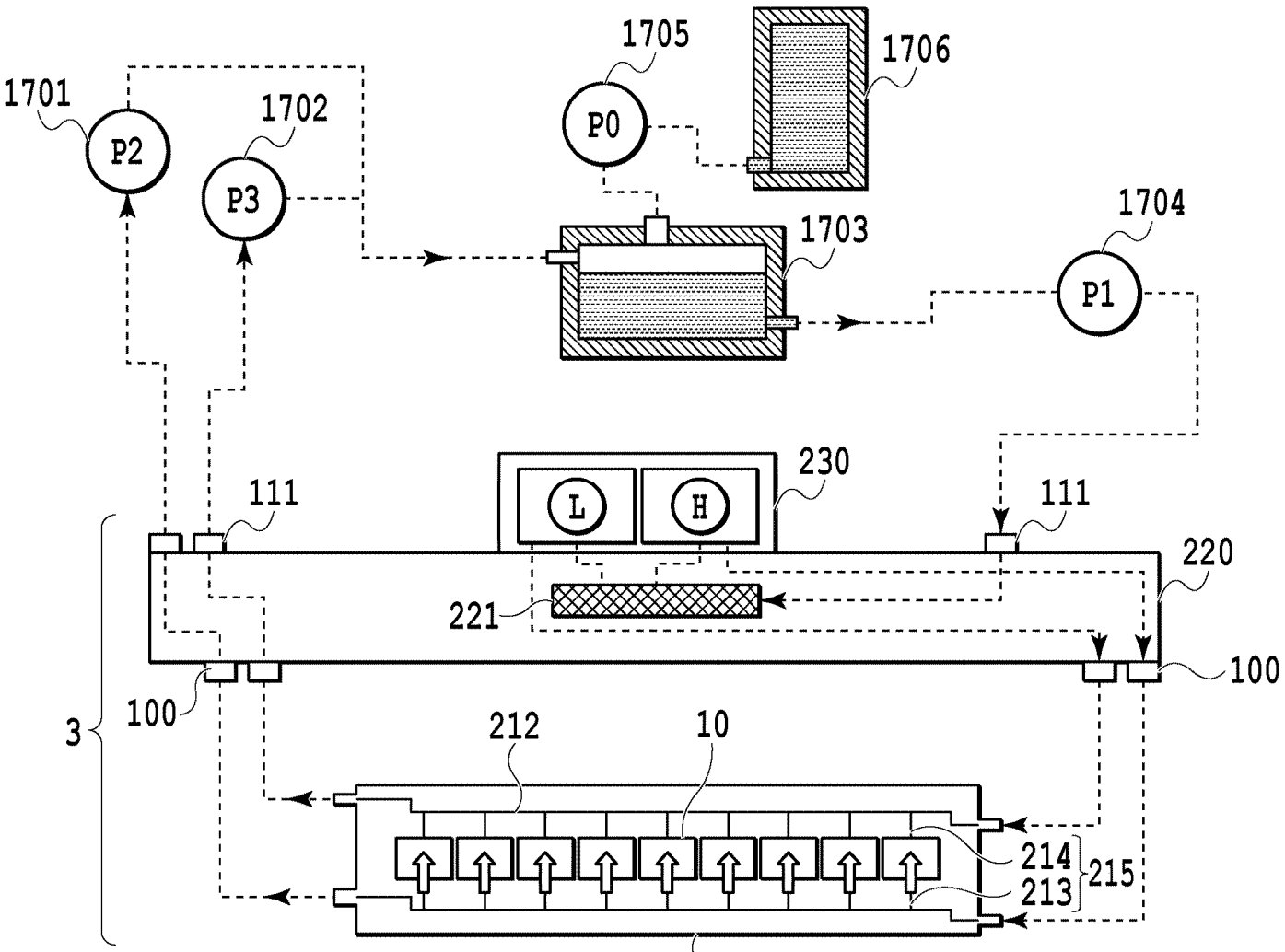
FIG. 17 is a schematic diagram showing an aspect of an ink route applied to a liquid discharge device according to the sixth embodiment.

FIG. 17 is a schematic diagram showing an aspect of an ink route applied to the liquid discharge device of this embodiment. As shown in FIG. 17, the liquid discharge head 3 creates the ink circulation inside the pressure chamber corresponding to each of the discharge ports mentioned above, by fluidically connecting a first circulation pump (high-pressure side) 1701, a first circulation pump (low-pressure side) 1702, a buffer tank 1703, and the like to one another. The ink inside a main tank 1706 is supplied to the buffer tank 1703 by using a replenishing pump 1705, and is then supplied to a liquid supply unit 220 of the liquid discharge head 3 via a liquid connector 111 by using the second circulation pump 1704. A liquid discharge unit 300 is provided with the common supply flow channel 211, the common recovery flow channel 212, and individual flow channels 215 (individual supply flow channels 213 and individual recovery channels 214) which communicate with the respective recording element boards. Note that FIG. 17 illustrates only the route for circulating the ink of a certain color for the purpose of simplifying the illustration and description. In reality, however, each liquid discharge head 3 is provided with as many circulation paths as the number of the colors required. The two first circulation pumps 1701 and 1702 have a function to draw the liquid from the liquid connector 111 of the liquid discharge head 3 and to send the liquid to the buffer tank 1703. Positive-displacement pumps each having a quantitative liquid sending capacity are preferably used for the first circulation pumps. Specific examples of the positive-displacement pumps include tube pumps, gear pumps, diaphragm pumps, syringe pumps, and the like. Alternatively, each first circulation pumps may include a typical constant flow valve or a typical relief valve disposed at a pump outlet so as to ensure a constant flow rate, for example.

When the liquid discharge head 3 is driven, a certain amount of the ink flows in each of the common supply flow channel 211 and the common recovery flow channel 212 by means of the first circulation pump (high-pressure side) 1701 and the first circulation pump (low-pressure side) 1702. A negative pressure control unit 230 is provided on a route between a second circulation pump 1704 and the liquid discharge unit 300. The negative pressure control unit 230 has an operating function to keep a pressure on the downstream side of the negative control unit 230 (i.e., the liquid discharge unit 300 side) at a preset constant pressure even when the flow rate of the circulation system varies due to a difference in duty during the recording. Such two pressure adjustment mechanisms constituting the negative pressure control unit 230 may apply any mechanisms as long as such mechanisms can control the pressure on the downstream side of the unit within a certain range of variation from a desired setting pressure. For example, a mechanism equivalent to a so-called "decompression regulator" is applicable. The second circulation pump 1704 only needs to have a lift pressure equal to or above a certain pressure within a range of a circulation flow rate of the ink used when driving the liquid discharge head 3. To be more precise, a diaphragm pump and the like are applicable. Meanwhile, instead of the second circulation pump 1704, it is also possible to apply a water header tank disposed at a certain water head difference from the negative pressure control unit 230, for example. In the case of performing the above-described circulation and supply, the ink at a relatively low temperature generally flows into the liquid discharge head while the ink at a relatively high temperature flows out of the liquid discharge head. Accordingly, the liquid discharge head applied to the liquid discharge device performing the above-described circulation and supply has a significant influence of the change in temperature. Therefore, the present invention is particularly effectively applicable thereto.

As shown in FIG. 17, the negative pressure control unit 230 includes the two pressure adjustment mechanisms of which control pressures are set different from each other. Of the two pressure adjustment mechanisms, the relatively high-pressure side (indicated with H) and the relatively low-pressure side (indicated with L) are connected to the common supply flow channel 211 and the common recovery flow channel 212 inside the liquid discharge unit 300 via the inside of the liquid supply unit 220, respectively. Since the difference in pressure is generated between the common flow channels communicating with the two pressure adjustment mechanisms that have the difference in pressure therebetween, the flow of the ink is created in all the pressure chambers 20 in the liquid discharge unit 300.

In the above-described configuration, there may be recording element boards in the range in the direction of the arrays of discharge ports of the liquid discharge heads, the recording element boards including the arrays of discharged ports not used for discharge. In this embodiment, the heating control is not performed on these recording element boards.

Figure 18A:
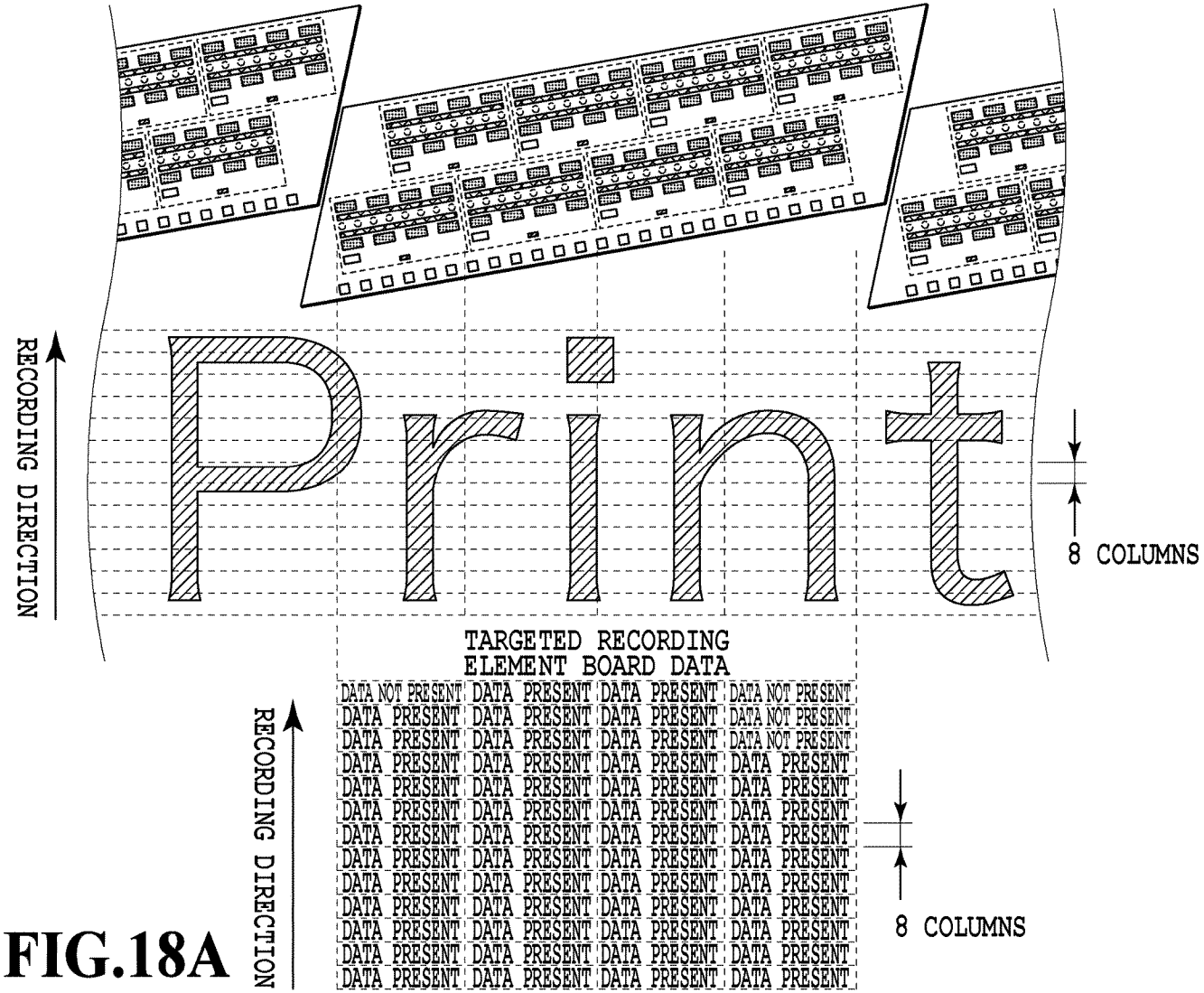
FIGS. 18A and 18B are diagrams describing heating ranges relative to discharge port ranges corresponding to recording data.
Figure 18B:
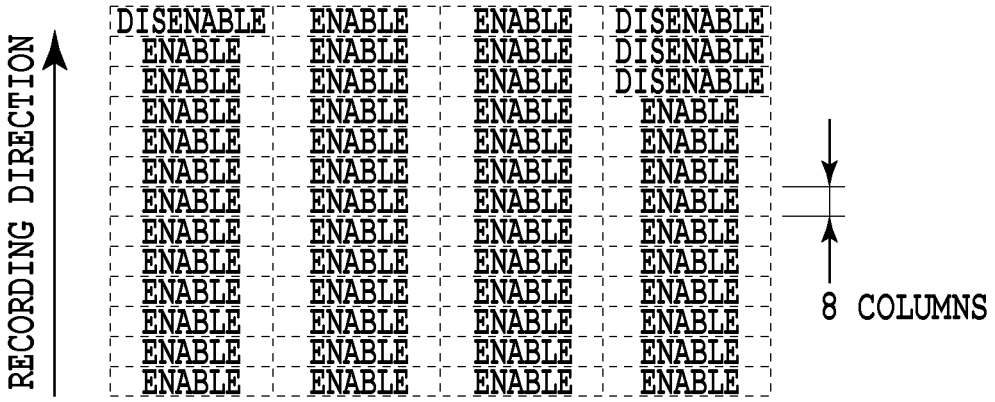

The temperature control of this embodiment is the same processing as the temperature control according to the third embodiment shown in FIGS. 10A and 10B. FIGS. 18A and 18B are diagrams describing heating ranges relative to discharge port ranges corresponding to recording data in the sixth embodiment. The heating control unit 1004 reads the data developed depending on the arrays of discharge ports of the respective recording element boards, and then determines the presence of the recording data depending on the column ranges. According to the configuration of this embodiment, it is possible to suppress the amount of evaporation from the liquid discharge heads as a whole even in the case of the inkjet recording head of a full-line type in which a large number of the recording element boards are not used.

This embodiment has described the example of providing the two pressure adjustment mechanisms collectively serving as a pressure difference generation source. However, any other configurations are also applicable as long as such configurations are consistent in principle.

The present invention can provide a configuration to perform heating control of temperatures of liquid discharge heads, which is capable of suppressing evaporation of a volatile component from discharge ports and suppressing uneven temperature distribution among multiple discharge ports arrayed therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A liquid discharge device to perform recording by use of a liquid discharge head including a plurality of discharge ports to discharge a liquid, a plurality of pressure generation elements to generate energy to be used to discharge the liquid, and a plurality of pressure chambers including the plurality of pressure generation elements and communicating with the plurality of discharge ports, the liquid discharge device comprising:

a control unit configured to control a temperature of the liquid discharge head by applying heat with heating elements arranged in a plurality of areas of a region of the liquid discharge head, the region being a region where the plurality of discharge ports are arranged, wherein a driver to drive the corresponding heating element is provided in each of the plurality of areas, when there is recording data for the discharge port in a certain one of the areas, the control unit causes the heating element in the certain area to generate heat, when there is no recording data for the discharge port in the certain area, the control unit keeps the heating element in the certain area from generating heat, and the plurality of heating elements is separate from the pressure generation elements.

2. The liquid discharge device according to claim 1, wherein the liquid discharge head further includes temperature detection elements provided for the plurality of the areas, respectively, the liquid discharge device further includes a detecting unit configured to detect temperature values detected by the temperature detection elements, and if the detecting unit detects any of the areas having a temperature equal to or below a predetermined threshold, the control unit causes the heating element in the area to generate heat.

3. The liquid discharge device according to claim 2, wherein each of the pressure generation elements heats the liquid to generate a bubble in the liquid, and thus generates the energy to be used to discharge the liquid.

4. The liquid discharge device according to claim 2, wherein each area corresponds to a recording element board provided with two or more of the pressure chambers, two or more of the pressure generation elements, and two or more of the heating elements.

5. The liquid discharge device according to claim 4, wherein the control unit starts heating by causing the plurality of heating elements to generate heat at a timing that is a predetermined period before a time to start recording.

6. The liquid discharge device according to claim 5, wherein the number of the heating elements arranged along an array direction of the discharge ports is less than the number of the pressure generation elements arranged along the array direction.

7. The liquid discharge device according to claim 6, wherein the liquid discharge head includes the recording element board, and a support member to support the recording element board, and regarding flow channels formed in the recording element board, common flow channels formed in the support member, and communication holes formed in the support member so as to allow the flow channels in the board and the common flow channels to communicate with each other, the number of the heating elements is equal to or greater than the number of the communication holes.

8. The liquid discharge device according to claim 6, wherein the liquid discharge head includes the recording element board, and a support member to support the recording element board, and regarding flow channels formed in a first board of the recording element board and communicating with two or more of the pressure chambers, flow channels formed in a second board of the recording element board and communicating with two or more of the pressure chambers, first communication holes communicating with the flow channels in the first board of the recording element board, and second communication holes communicating with the flow channels in the second board of the recording element board, the number of the heating elements is equal to or greater than the number of the first communication holes and the second communication holes.

9. The liquid discharge device according to claim 8, wherein a pressure in each of the first communication holes is higher than a pressure in each of the second communication holes.

10. The liquid discharge device according to claim 8, wherein thermal diffusivity of the support member is lower than thermal diffusivity of the recording element board.

11. The liquid discharge device according to claim 10, wherein in the liquid discharge head, a plurality of the recording element boards are arranged on the support member, and the pressure generation elements in each of the recording element boards overlap the pressure generation elements in its adjacent recording element board with respect to a conveyance direction of a record medium.

12. The liquid discharge device according to claim 2, wherein each area is a region including two or more of the pressure chambers, and a plurality of supply ports communicating with the two or more pressure chambers.

13. The liquid discharge device according to claim 2, wherein each area is a sub-region including one of the heating elements.

14. A liquid discharge head comprising:

a plurality of discharge ports to discharge a liquid;

a plurality of pressure generation elements to generate energy to be used to discharge the liquid; and a plurality of pressure chambers communicating with the plurality of discharge ports, each of the pressure chambers including one of the pressure generation elements, wherein heating elements are arranged in a plurality of areas of a region of the liquid discharge head, the region being a region where the plurality of discharge ports are arranged, a driver to drive the corresponding heating element is provided in each of the plurality of areas, and the number of the heating elements arranged along an array direction of the discharge ports is less than the number of the pressure generation elements arranged along the array direction.

15. The liquid discharge head according to claim 14, further comprising a recording element board, and a support member to support the recording element board, wherein regarding flow channels formed in the recording element board, common flow channels formed in the support member, and communication holes formed in the support member so as to allow the flow channels in the board and the common flow channels to communicate with each other, the number of the heating elements is equal to or greater than the number of the communication holes.

16. The liquid discharge head according to claim 15, wherein thermal diffusivity of the support member is lower than thermal diffusivity of the recording element board.

17. The liquid discharge head according to claim 16, wherein in the liquid discharge head, a plurality of the recording element boards are arranged on the support member, and the pressure generation elements in each of the recording element boards overlap the pressure generation elements in its adjacent recording element board with respect to a conveyance direction of a record medium.

18. The liquid discharge head according to claim 14, further comprising a recording element board, and a support member to support the recording element board, wherein regarding flow channels formed in a first board of the recording element board and communicating with two or more of the pressure chambers, flow channels formed in a second board of the recording element board and communicating with two or more of the pressure chambers, first communication holes communicating with the flow channels in the first board of the recording element board, and second communication holes communicating with the flow channels in the second board of the recording element board, the number of the heating elements is equal to or greater than the number of the first communication holes and the second communication holes.

19. The liquid discharge head according to claim 14, wherein the liquid is circulated between inside of the pressure chambers and outside of the pressure chambers.

20. The liquid discharge head according to claim 14, further comprising:

a recording element board including the discharge ports, the pressure generation elements and the pressure chambers; and a support member to support the recording element board, the support member including a flow channel for supplying liquid to the recording element board.

21. The liquid discharge head according to claim 20, wherein the liquid discharge head is page-wide type head including a plurality of the recording element boards.

22. The liquid discharge head according to claim 21, wherein the plurality of the recording element boards are arranged in a straight line.

23. The liquid discharge head according to claim 20, wherein the recording element board is configured to eject a plurality of different types of liquids.

24. A liquid discharge device to perform recording by use of a liquid discharge head including a plurality of discharge ports to discharge a liquid, a plurality of pressure generation elements to generate energy to be used to discharge the liquid, and a plurality of pressure chambers including the plurality of pressure generation elements and communicating with the plurality of discharge ports, the liquid discharge device comprising:

a control unit configured to control a temperature of the liquid discharge head by applying heat with heating elements arranged in a plurality of areas of a region of the liquid discharge head, the region being a region where the plurality of discharge ports are arranged, wherein a driver to drive the corresponding heating element is provided in each of the plurality of areas, when there is recording data for the discharge port in a certain one of the areas, the control unit causes the heating element in the certain area to generate heat, when there is no recording data for the discharge port in the certain area, the control unit keeps the heating element in the certain area from generating heat, and the number of the heating elements arranged along an array direction of the discharge ports is less than the number of the pressure generation elements arranged along the array direction.

25. The liquid discharge device according to claim 24, wherein the liquid discharge head includes the recording element board, and a support member to support the recording element board, and regarding flow channels formed in the recording element board, common flow channels formed in the support member, and communication holes formed in the support member so as to allow the flow channels in the board and the common flow channels to communicate with each other, the number of the heating elements is equal to or greater than the number of the communication holes.

26. The liquid discharge device according to claim 24, wherein the liquid discharge head includes the recording element board, and a support member to support the recording element board, and regarding flow channels formed in a first board of the recording element board and communicating with two or more of the pressure chambers, flow channels formed in a second board of the recording element board and communicating with two or more of the pressure chambers, first communication holes communicating with the flow channels in the first board of the recording element board, and second communication holes communicating with the flow channels in the second board of the recording element board, the number of the heating elements is equal to or greater than the number of the first communication holes and the second communication holes.

27. The liquid discharge device according to claim 26, wherein a pressure in each of the first communication holes is higher than a pressure in each of the second communication holes.

28. The liquid discharge device according to claim 26, wherein thermal diffusivity of the support member is lower than thermal diffusivity of the recording element board.

29. The liquid discharge device according to claim 24, wherein in the liquid discharge head, a plurality of the recording element boards are arranged on the support member, and the pressure generation elements in each of the recording element boards overlap the pressure generation elements in its adjacent recording element board with respect to a conveyance direction of a record medium.

* * * * *